US005699768A

United States Patent [19]

Saito et al.

[11] Patent Number: 5,699,768

[45] Date of Patent: Dec. 23, 1997

[54] THROTTLE CONTROL DEVICE

[75] Inventors: Yasuo Saito; Shigenori Tahara; Hiroyuki Yamada, all of Hitachinaka; Atsushi Hohkita, Hitachi, all of Japan

[73] Assignees: Hitachi, Ltd.; Hitachi Car Engineering Co., Ltd., both of Japan

[21] Appl. No.: 713,036

[22] Filed: Sep. 12, 1996

[30] Foreign Application Priority Data

Dec. 9, 1995 [JP] Japan ..... 7-233981

[51] Int. Cl.[6] ..... F02D 11/04

[52] U.S. Cl. ..... 123/400

[58] Field of Search ..... 123/399, 400, 123/403, 342

[56] References Cited

U.S. PATENT DOCUMENTS

| | | | |
|---|---|---|---|
| 4,616,518 | 10/1986 | Nusser | 123/400 |
| 4,945,874 | 8/1990 | Nishitani et al. | 123/400 |
| 4,969,437 | 11/1990 | Kolb | 123/400 |
| 4,971,006 | 11/1990 | Imaeda | 123/400 |
| 5,078,111 | 1/1992 | McCann | 123/400 |
| 5,178,112 | 1/1993 | Terazawa et al. | 123/400 |
| 5,215,057 | 6/1993 | Sato et al. | 123/400 |
| 5,423,299 | 6/1995 | Kumagai | 123/400 |
| 5,524,590 | 6/1996 | Jung | 123/400 |

FOREIGN PATENT DOCUMENTS 5-52409 8/1993 Japan .

*Primary Examiner*—Willis R. Wolfe

*Attorney, Agent, or Firm*—Evenson, McKeown, Edwards & Lenahan, P.L.L.C.

[57] ABSTRACT

A throttle control device freely sets the throttle opening area changing ratio in the low opening degree range to the intermediate and high opening degree range. The throttle valve is rotatably supported to an air intake passage to vary the area of the air intake passage, and rotated by a throttle lever fixed to the throttle valve. A drive lever is rotated with stepping down of an accelerator pedal by the driver. A cam mechanism transmits rotation of the drive lever, to the throttle lever and a link mechanism having a connecting lever transmits rotation of the drive lever to the throttle lever. The cam mechanism and the link mechanism are switched to be operated corresponding to the opening degree of the throttle valve.

19 Claims, 13 Drawing Sheets

THROTTLE CONTROL DEVICE

BACKGROUND AND SUMMARY OF THE INVENTION

The present invention relates to a throttle control device and, more particularly, to a throttle control device suitable for controlling throttle opening arranged in an air intake passage of an engine for a vehicle.

In order to improve driving capability of a vehicle, studies have been undertaken to optimize a changing ratio of throttle opening area to accelerator control quantity (hereinafter referred to as "throttle opening area changing ratio").

It is known that in a high power internal combustion engine for a vehicle, the throttle opening area changing ratio is set to a small value when the throttle valve is in a low opening degree range and the throttle opening area changing ratio is set to a large value when the throttle valve is in an intermediate opening degree range to a high opening degree range in order to prevent the vehicle from abrupt starting or to prevent the engine from stopping when the accelerator pedal is stepped a little deeper at starting being difficult to operate the accelerator pedal or during low speed running, or in order to prevent an excessive effect of engine brake, and in order to attain sensitive response of the engine to the accelerator control quantity during intermediate and high speed running.

A detailed method to realize the above function is disclosed, for example, in Japanese Patent Publication No. 552409(1993) where a link mechanism is provided between an accelerator wire cable and a throttle shaft.

However, because the throttle opening area changing ratio is changed by the link mechanism in the above conventional method, the method cannot further improve the driving capability. For example, the conventional link mechanism is generally used in a vehicle being comparatively light in vehicle weight and mounting an engine having a displacement volume of nearly 2000 cc. In a vehicle mounting an engine having a displacement volume of nearly 4000 cc and being comparatively light in vehicle weight even having such a large displacement volume, there is a need that the throttle opening area changing ratio is further decreased in the low opening degree range of the throttle valve because of the large torque at a low speed and the light vehicle weight, and the throttle opening area changing ratio is further increased in the intermediate opening degree range and in the high opening degree range so that the vehicle may sportily run in taking advantage of the light vehicle weight. However, there has been a problem in that the conventional link mechanism cannot cope with such a need for the throttle opening area changing ratio.

In a vehicle using an engine having a displacement volume as small as nearly 1000 cc, there is a need to increase the throttle opening area changing ratio in the low opening degree range in order to make up with the small torque at a low speed, and to decrease the throttle opening area changing ratio in the intermediate opening degree range and the high opening degree range. However, there has been a problem in that the conventional link mechanism cannot freely set the throttle opening area changing ratio.

An object of the present invention is to provide a throttle control device capable of freely setting the throttle opening area changing ratio in the low opening degree range to the intermediate and high opening degree range.

The object of the present invention can be attained by providing a throttle control device which comprises a throttle valve for varying an area of an air intake passage supported rotatably to the air intake passage, a throttle lever for rotating the throttle valve fixed to the throttle valve, a drive lever being rotated in being linked with stepping of an accelerator pedal, a cam mechanism for transmitting rotation of the drive lever to the throttle lever, and a link mechanism for transmitting the rotation of the drive lever to the throttle lever, the cam mechanism and the link mechanism being operated by being switched corresponding to an opening degree of the throttle valve.

In the above throttle control device, it is preferable that the cam mechanism is constructed by engaging a cam surface formed on one of the driver lever and the throttle lever with a part of the other lever, the link mechanism being constructed by a connecting lever in such that one end of the connecting lever is supported by the driver lever and a pin provided in the other end is engaged with a long hole formed in the throttle lever. The pin provided in the other end of the throttle lever is play-coupled with the long hole so that the link mechanism does not function when the cam mechanism is operated, and the cam mechanism is brought in a non-contact state so that the cam mechanism does not function when the link mechanism is operated.

In the above throttle control device, the cam mechanism is constructed by engaging a cam surface formed on one of the driver lever and the throttle lever with a part of the other lever. The link mechanism is constructed by a connecting lever such that one end of the connecting lever is supported by the throttle lever and a pin provided in the other end is engaged with a long hole formed in the driver lever. The pin provided in the other end of the throttle lever is play-coupled with the long hole so that the link mechanism does not function when the cam mechanism is operated, and the cam mechanism is brought in a non-contact state so that the cam mechanism does not function when the link mechanism is operated.

The above throttle control device, it is preferable that the above throttle control device further comprises an assisting means for giving a force in a direction of closing the throttle valve when the cam mechanism is operated, the force varying corresponding to opening degree of the throttle valve.

The assisting means is constructed by a compressed spring, of which one end is engaged with the pin of the connecting lever and the other end is engaged with the driver lever or the throttle lever having the long hole.

The cam mechanism is constructed by engaging a cam surface formed in a portion of the driver lever with a cam surface formed in a portion of the throttle lever.

The cam mechanism is constructed by engaging a cam surface formed in a portion of the driver lever with a roller rotatably supported in a portion of the other lever.

The cam mechanism is operated when the throttle valve is in a low opening degree range, and the link mechanism is operated when the throttle valve is in an intermediate and high opening degree range.

The link mechanism is operated when the throttle valve is in a low opening degree range, and the cam mechanism is operated when the throttle valve is in an intermediate and high opening degree range.

A changing ratio of the throttle valve in a low opening degree range is smaller than a changing ratio of the throttle valve in an intermediate and high opening degree range.

A changing ratio of the throttle valve in a low opening degree range is larger than a changing ratio of the throttle valve in an intermediate and high opening degree range.

According to the present invention, the throttle control device is capable of freely setting the throttle opening area changing ratio in the low opening degree range to the intermediate and high opening degree range, because the throttle control device comprises a throttle valve for varying an area of an air intake passage supported rotatably to the air intake passage, a throttle lever for rotating the throttle valve fixed to the throttle valve, a drive lever being rotated in being linked with stepping of an accelerator pedal, a cam mechanism for transmitting rotation of the drive lever to the throttle lever, and a link mechanism for transmitting the rotation of the drive lever to the throttle lever. The cam mechanism and the link mechanism are operated by being switched corresponding to an opening degree of the throttle valve.

It is possible to easily switch the cam mechanism and the link mechanism, because the cam mechanism is constructed by engaging a cam surface formed on one of the driver lever and the throttle lever with a part of the other lever. The link mechanism is constructed by a connecting lever such that one end of the connecting lever is supported by the driver lever and a pin provided in the other end is engaged with a long hole formed in the throttle lever. The pin provided in the other end of the throttle lever is play-coupled with the long hole so that the link mechanism does not function when the cam mechanism is operated, and the cam mechanism is brought in a non-contact state so that the cam mechanism does not function when the link mechanism is operated.

Further, it is possible to easily switch the cam mechanism and the link mechanism because the cam mechanism is constructed by engaging a cam surface formed on one of the driver lever and the throttle lever with a part of the other lever. The link mechanism is constructed by a connecting lever such that one end of the connecting lever is supported by the throttle lever and a pin provided in the other end is engaged with a long hole formed in the driver lever. The pin provided in the other end of the throttle lever is play-coupled with the long hole so that the link mechanism does not function when the cam mechanism is operated, and the cam mechanism is brought in a non-contact state so that the cam mechanism does not function when the link mechanism is operated.

It is possible to improve the feel of the accelerator pedal because the throttle control device of the present invention further comprises an assisting apparatus for giving a force in a direction of closing the throttle valve when the cam mechanism is operated, with the force varying corresponding to opening degree of the throttle valve.

Further, it is possible to reduce the size of the assisting apparatus because the assisting apparatus is constructed by a compressed spring of which one end is engaged with the pin of the connecting lever and the other end is engaged with the driver lever or the throttle lever having the long hole.

It is possible to reduce number of parts composing the cam mechanism because the cam mechanism is constructed by engaging a cam surface formed in a portion of the driver lever with a cam surface formed in a portion of the throttle lever.

Further, it is possible to improve the reliability of the cam mechanism because the cam mechanism is constructed by engaging a cam surface formed in a portion of the driver lever with a roller rotatably supported in a portion of the other lever.

It is possible to increase the freedom in the characteristic of the low opening degree range because the cam mechanism is operated when the throttle valve is in a low opening degree range, and the link mechanism is operated when the throttle valve is in an intermediate and high opening degree range.

Further, it is possible to increase the freedom in the characteristic of the low opening degree range because the link mechanism is operated when the throttle valve is in a low opening degree range, and the cam mechanism is operated when the throttle valve is in an intermediate and high opening degree range.

It is possible to easily provide the throttle valve with a delay opening characteristic because a changing ratio of the throttle valve in a low opening degree range is smaller than a changing ratio of the throttle valve in an intermediate and high opening degree range.

Further, it is possible to easily provide the throttle valve with an advance opening characteristic because a changing ratio of the throttle valve in a low opening degree range is larger than a changing ratio of the throttle valve in an intermediate and high opening degree range.

BRIEF DESCRIPTION OF THE DRAWINGS

These and other objects, features and advantages will become more apparent from the following detailed description of two presently preferred embodiments when taken in conjunction with the accompanying drawings wherein.

DETAILED DESCRIPTION OF THE DRAWINGS

Figure 1:
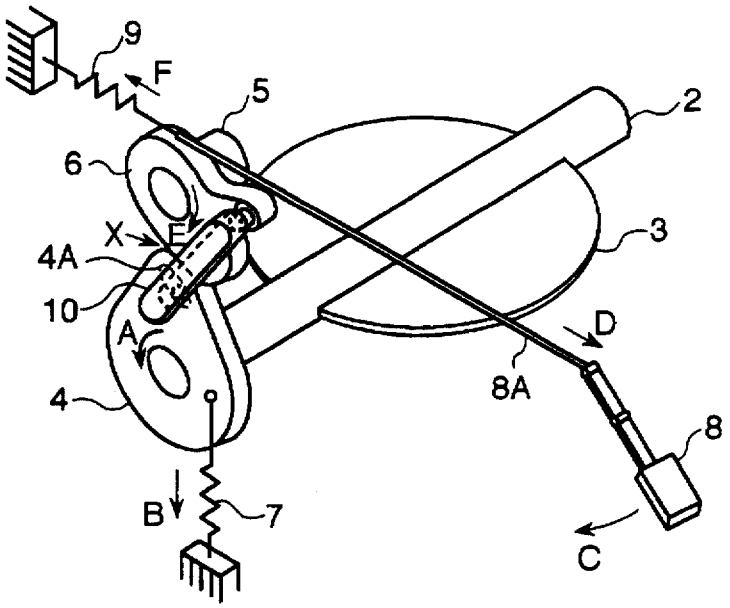
FIG. 1 is a perspective view schematically showing a main part of an embodiment of a throttle control device in accordance with the present invention.

Referring now to FIG. 1, a disk throttle valve 3 is fixed to a throttle shaft 2. The throttle shaft 2 is supported rotatably around its axis to an air intake passage which is not shown. The air intake passage is connected to an air cleaner on the upstream side and to a combustion chamber of an internal combustion engine on the downstream side. Therefore, the tilting angle of the throttle valve 3 to the air intake passage is varied by rotation of the throttle shaft 2, and accordingly the opening area to the air intake passage of the throttle valve 3 is varied, and then the intake air flow rate entering into the combustion chamber of the internal combustion engine can be likewise varied.

A throttle lever 4 is fixed to one end of the throttle shaft 2. The throttle opening area to the air intake passage is increased by rotation of the throttle lever 4 in a direction shown by an arrow A. One end of a tension spring 7 is attached to the throttle lever 4, and the other end is attached to a fixed portion. The tension spring 7 applies a tensile force in a direction shown by arrow B, and the force of the tension spring 7 acts on the throttle valve 3 in a direction to fully close the air intake passage.

One end of a drive shaft 5 is fixed to the air intake 14 passage. The other end of the drive shaft 5 is rotatably supported by a drive lever 6. An accelerator pedal 8 is connected to the drive lever 6 though a throttle wire 8A. By stepping down on the accelerator pedal 8 in the direction of an arrow C, the throttle wire 8A moves in the direction of an arrow D to rotate the drive lever 6 in the direction of an arrow E. One end of a tension spring 9 is attached to the driver lever 6 and the other end is attached to a fixed portion. The tension spring 9 produces a tensile force in the direction of an arrow F on the drive lever 6 so as to rotate in the direction opposite to the direction of an arrow E.

Two kinds of rotating force transmitting mechanisms are provided between the drive lever 6 and the throttle lever 4. Because the detailed construction of the rotating force transmitting mechanisms will be described later referring to FIG. 2 to FIG. 4, only the outline of the mechanisms will be described here. One of the rotating force transmitting mechanisms is a link mechanism using a connecting lever 10. One end of the connecting lever 10 is rotatably supported by the drive lever 6. The other end of the connecting lever 10 is slidably engaged with a long hole 4A formed in the throttle lever 4.

The other of the rotating force transmitting mechanisms is a cam mechanism in which the cam surface of the driver lever 6 directly touches the cam surface of the throttle lever 4. The cam surface of the driver lever 6 touches the cam surface of the throttle lever 4 at a portion indicated by an arrow X.

As the accelerator pedal 8 is stepped down to be rotated in the direction of the arrow C, the throttle wire 8A is moved toward the direction of the arrow D to rotate the drive lever 6 in the direction of the arrow E. This rotation of the drive lever 6 is transmitted to the throttle lever 4 through the cam mechanism or the link mechanism described above, and the throttle lever 4 is rotated in the direction of the arrow A to open the throttle valve 3 and accordingly to increase the throttle opening area.

The aforementioned two rotating force transmitting mechanisms are used by being switched corresponding to a stepping amount of the accelerator pedal 8. When the stepping amount of the accelerator pedal 8 is within a small range, that is, when the opening degree of the throttle valve is within the range of small opening degree, the rotating force is transmitted from the drive lever 6 to the throttle lever 4 through the cam mechanism. When the stepping amount of the accelerator pedal 8 is in a large range, that is, when the opening degree of the throttle valve is in the range of intermediate and high opening degree, the rotating force is transmitted from the drive lever 6 to the throttle lever 4 through the link mechanism 10.

By using the two kinds of rotating force transmitting mechanisms as described above, a throttle opening area changing ratio in a small stepping amount range of the accelerator pedal 8, that is, in the range of small opening degree of the throttle valve can be set by the cam mechanism, and a throttle opening area changing ratio in a large stepping amount range of the accelerator pedal 8, that is, in the range of intermediate and high opening degree of the throttle valve can be set by the link mechanism 10. The throttle opening area changing ratio in the small opening degree range of the throttle valve can be arbitrarily set by cam shapes of the drive lever 6 and the throttle lever 4. The throttle opening area changing ratio in the intermediate and high opening degree range of the throttle valve can be arbitrarily set by the link length of the link mechanism 10.

Figure 2:
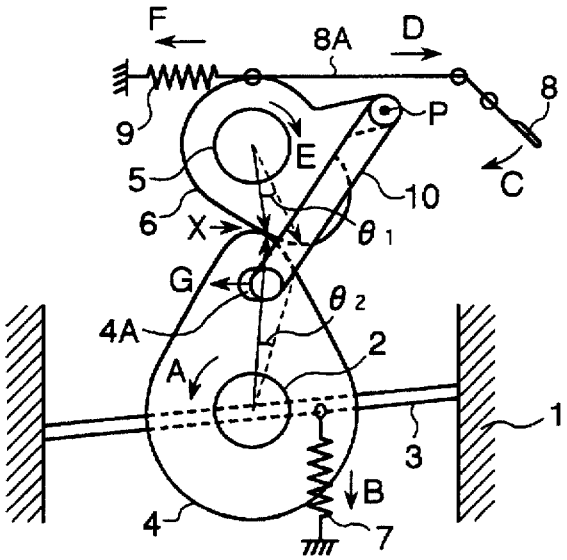
FIG. 2 is a front view illustrating the operation of transmitting rotating force by a cam mechanism in a rotating force transmitting mechanism of an embodiment of the throttle control device in accordance with the present invention.

In FIG. 2, the throttle shaft 2, to which the throttle valve 3 is fixed, is supported rotatably around its axis to an air intake passage. The air intake passage 1 is connected to an air cleaner in the upstream side (upper side in the figure) and to a combustion chamber of an internal combustion engine in the downstream (bottom side of the figure). Therefore, the tilting angle of the throttle valve 3 to the air intake passage 1 is varied by rotation of the throttle shaft 2 in the direction of the arrow A, and accordingly the opening area to the air intake passage 1 of the throttle valve 3 is varied, and then the intake air flow rate entering into the combustion chamber of the internal combustion engine can be varied. The state illustrated in FIG. 2 is a fully closed state of the throttle valve.

A throttle lever 4 is fixed to one end of the throttle shaft 2. The throttle opening area to the air intake passage is increased by rotation of the throttle lever 4 in a direction of arrow A. One end of the tension spring 7 is attached to the throttle lever 4, and the other end is attached to a fixed portion. The tension spring 7 applies a tensile force in a direction shown by the arrow B, and the force of the tension spring 7 acts on the throttle valve 3 in a direction to fully close the air intake passage.

The drive shaft is fixed to the air intake passage 1. The drive shaft 5 is rotatably supported by a drive lever 6. The accelerator pedal 8 is connected to the drive lever 6 though the throttle wire 8A. By stepping down on the accelerator pedal 8 in the direction of arrow C, the throttle wire 8A moves in the direction of arrow D to rotate the drive lever 6 in the direction of arrow E. One end of the tension spring 9 is attached to the driver lever 6 and the other end is attached to a fixed portion. The tension spring 9 produces a tensile force in the direction of arrow F, and the tension spring 9 acts the force on the drive lever 6 so as to rotate in the opposite direction to the direction of arrow E.

As shown in FIG. 2, in the fully closed state of the throttle valve 3, the cam surface of the driver lever 6 touches the cam surface of the throttle lever 4 at a portion indicated by arrow X. The range of angle θ1 in the outer peripheral surface of the drive lever 6 is an effective cam surface, and the range of angle θ2 in the outer peripheral surface of the throttle lever 4 is an effective cam surface. When the drive lever 6 is rotated in the direction of the arrow E, the rotation is transmitted to the throttle lever 4 to rotate the throttle lever 4 in the direction of the arrow A because the cam surface of the drive lever 6 touches the cam surface of the throttle lever 4. The transmission of the rotating force by the cam surface is continued until the state shown in FIG. 3.

Next, the link mechanism constituted by the connecting lever 10 will be described below. One end of the connecting lever 10 is rotatably supported by the drive lever 6 in a point P as a fulcrum. A pin 10A provided in the other end of the connecting lever 10 is slidably engaged with a long hole 4A formed in the throttle lever 4.

Because the long hole 4A is long-circular shaped, the left side end of the pin 10A of the connecting lever 10 does not touch the left side end of the long hole 4A in the state shown in FIG. 2. Therefore, in this state, even if the drive lever 6 is rotated in the direction of the arrow E and the pin 10A of the connecting lever 10 is moved to the direction of the arrow G, driving force is not transmitted from the connecting lever 10 to the throttle lever 4. That is, in the state shown in FIG. 2, the rotating force of the drive lever 6 is transmitted by the cam mechanism touching at the portion indicated by the arrow X, but the connecting lever 10 does not work.

Figure 3:
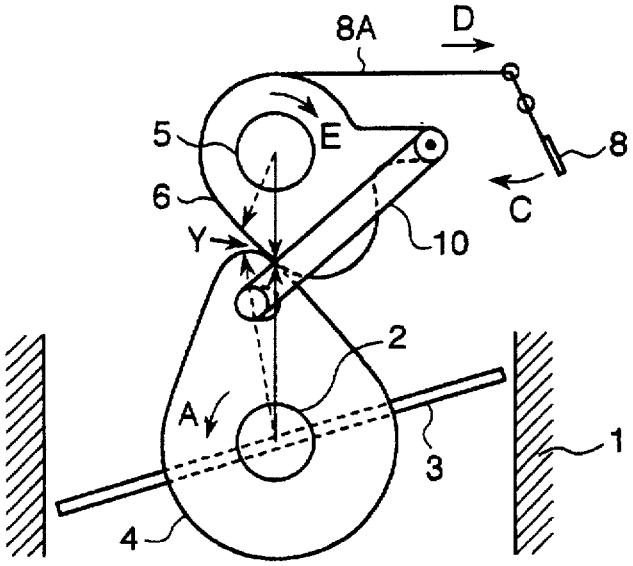
FIG. 3 is a front view illustrating the operation of transmitting rotating force at switching from the cam mechanism to a link mechanism in the rotating force transmitting mechanism of an embodiment of the throttle control device in accordance with the present invention.

FIG. 3 shows a state where the drive lever 4 is rotated from the state of FIG. 2 by an angle θ2. In FIG. 3, the same parts are identified by the same reference characters in FIG. 2. Here, the tension springs 7, 9 are omitted.

The state shown in FIG. 3 is a state of switching point of the cam mechanism to the link mechanism. The surface of the drive lever 6 touches the cam surface of the throttle lever 4 at a portion shown by the arrow Y, and at the same time the left side end of the pin 10A of the connecting lever 10 touches the left side end of the long hole 4A formed in the throttle lever 4.

As the accelerator pedal 8 is further stepped down from this state and the drive lever 6 is rotated in the direction shown by the arrow E, the contact between the cam surface of the drive lever 6 and the cam surface of the throttle lever 4 is released and the cam mechanism ceases to function. At the same time, the rotation of the drive lever 6 in the direction of the arrow E rotates the throttle lever 4 in the direction of the arrow A through the connecting lever 10 by engaging the pin 10A of the connecting lever 10 with the long hole 4A.

Figure 4:
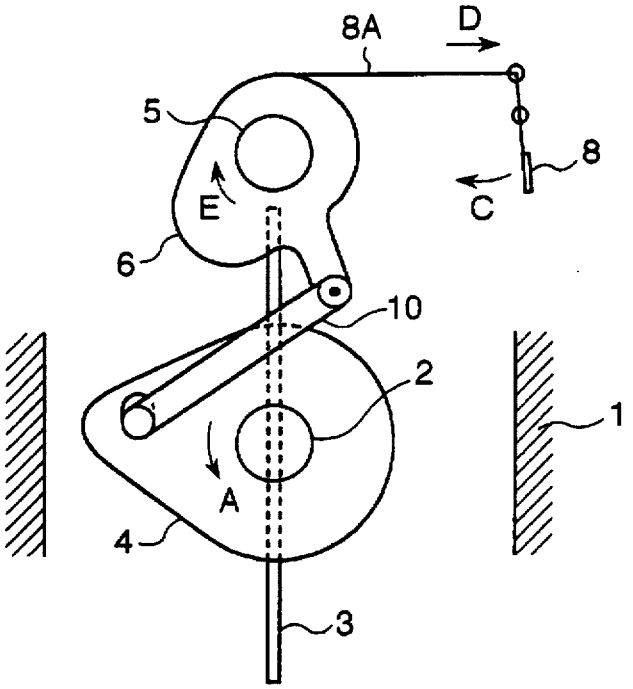
FIG. 4 is a front view illustrating the operation of transmitting rotating force by the link mechanism in the rotating force transmitting mechanism of an embodiment of the throttle control device in accordance with the present invention.

FIG. 4 shows a state where the link mechanism begins to operate from the state of FIG. 3 and the throttle valve is brought to the full open state. In FIG. 4, the same parts are identified by the same reference characters in FIG. 2. Here, the tension springs 7, 9 are also omitted.

As the accelerator pedal 8 is further stepped down from the state of FIG. 3 and the drive lever 6 is rotated in the direction shown by the arrow E, by the action of the connecting lever 10 composing the link mechanism, the pin 10A of the connecting lever 10 engages with the long hole 4A and the throttle lever 4 is rotated in the direction of the arrow A to bring the throttle valve 3 in the full open state.

When the accelerator pedal 8 is turned back, the drive lever 6 is rotated in the opposite direction of the arrow E by the action of the tension spring 9, and the throttle lever 4 is rotated in the opposite direction of the arrow A by the action of the tension spring 7 to move the throttle valve 3 toward the closing state.

When the throttle valve 3 is closed, the state changes from the state of FIG. 4 through the state of FIG. 3 to the state of FIG. 2 of the full closed state. Therefore, the throttle opening area changing ratio is determined by the link mechanism of the connecting lever 10 in the intermediate and high opening degree range, and by the cam mechanism in the the low opening degree range.

Figure 5:
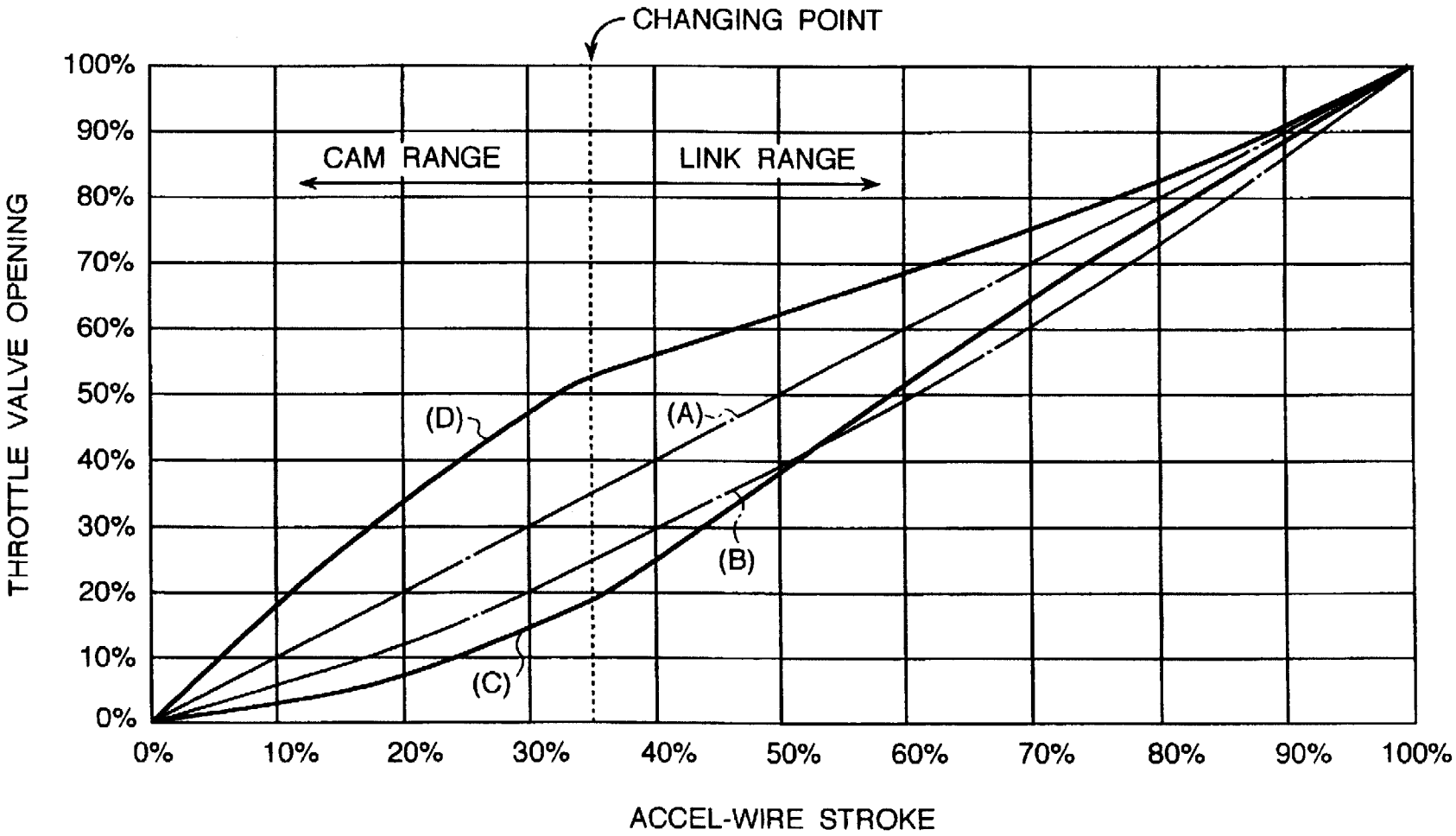
FIG. 5 is a graph showing the relationship between accelerator wire stroke and throttle opening degree of an embodiment of the throttle control device in accordance with the present invention.

In FIG. 5, dash-dot lines (A), (B) show characteristics of conventional throttle opening area changing ratio. The dash-dot line (A) shows the characteristic for a constant throttle opening area changing ratio. The dash-dot line (B) shows the characteristic of throttle opening area changing ratio using a conventional link mechanism where the throttle opening area changing ratio is small in the low opening degree range, and the throttle opening area changing ratio is large in the intermediate and high opening degree range.

Whereas, in the present invention, as shown by a line (C), by adding a delay opening characteristic the throttle opening area changing ratio can be further smaller in the low opening degree range than that of the link mechanism shown by the dash-dot line (B), and the throttle opening area changing ratio can be further larger in the intermediate and high opening degree range than that of the dash-dot line (B) because the cam mechanism has a larger freedom in the characteristic compared to that of the link mechanism. Although the freedom in the characteristic of the link mechanism is small, the durability can be improved by obtaining the characteristic using the link mechanism over the whole range or most range of the accelerator wire stroke since the link mechanism is durable.

By changing the shape of the cam surface of the cam mechanism and the proportion of the link mechanism, as shown by the line (D), the throttle opening area changing ratio can be larger in the low opening degree range than that of the dash-dot line (A), and by adding an advanced opening characteristic the throttle opening area changing ratio can be small in the intermediate and high opening degree range.

Although in the above description the long hole is provided in the throttle lever side, a long hole can be provided in the drive lever side and the hole engaged with a pin provided in one end of the connector lever which is engaged with the throttle lever.

According to this embodiment, by providing the delayed opening characteristic of the throttle, it is possible to satisfy the need that the throttle opening area changing ratio can be smaller in the low opening degree range, and the throttle opening area changing ratio can be larger in the intermediate and high opening degree range. For example, in a vehicle mounting an engine having a displacement volume of nearly 4000 cc and being comparatively light in vehicle weight even having such a large displacement volume, the driving ability in a slow speed region can be improved and the sensitive response in an intermediate and high speed region can be attained.

Further, by changing the shape of the cam surface of the cam mechanism and the proportion of the link mechanism, in a vehicle using an engine having a displacement volume as small as nearly 1000 cc, the throttle opening area changing ratio is increased in the low opening degree range in order to make up with the small torque at a low speed, and the throttle opening area changing ratio is decreased in the intermediate opening degree range and the high opening degree range. By doing so, the driving ability from a slow speed region to an intermediate and high speed region can be improved.

Furthermore, as for the cam mechanism, it is possible that number of parts of the cam mechanism can be reduced by using the cam surface formed in the drive lever and the cam surface formed in the throttle lever.

Figure 6:
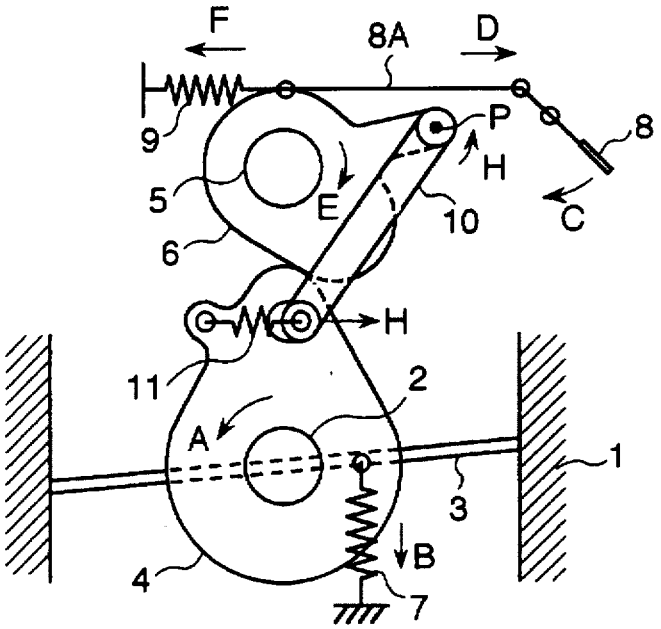
FIG. 6 is a front view illustrating the operation of transmitting rotating force by a cam mechanism in a rotating force transmitting mechanism of another embodiment of the throttle control device in accordance with the present invention.
Figure 7:
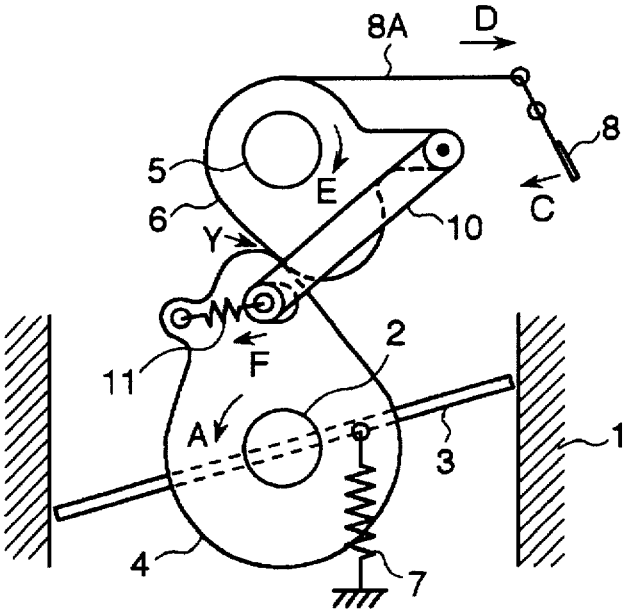
FIG. 7 is a front view illustrating the operation of transmitting rotating force at switching from the cam mechanism to a link mechanism in the rotating force transmitting mechanism of another embodiment of the throttle control device in accordance with the present invention.
Figure 8:
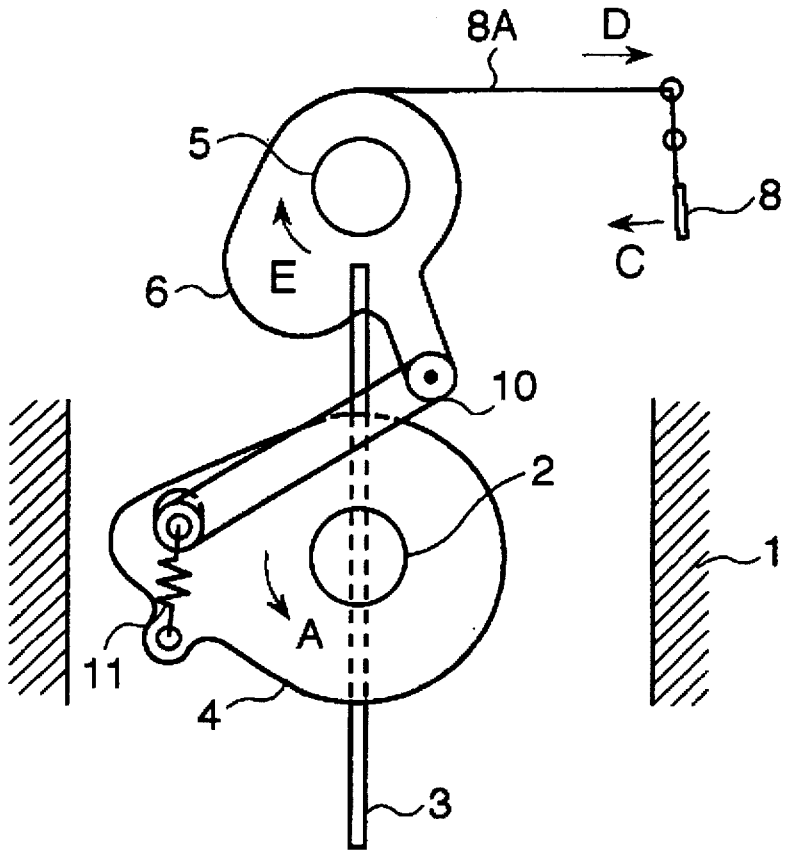
FIG. 8 is a front view illustrating the operation of transmitting rotating force by the link mechanism in the rotating force transmitting mechanism of another embodiment of the throttle control device in accordance with the present invention.

FIG. 6 to FIG. 8 are front views explaining illustrating the operation of the main part of the rotating force transmitting mechanism of the throttle control device in accordance with another embodiment of the present invention. FIG. 6 illustrates the operation of transmitting rotating force by the cam mechanism. FIG. 7 illustrates the operation of transmitting rotating force at switching from the cam mechanism to the link mechanism. FIG. 8 illustrates the operation of transmitting rotating force by the link mechanism.

This embodiment differs from the embodiment shown in FIG. 2 to FIG. 4 in that a compression spring 11 is provided in the former.

In FIG. 6, the throttle shaft 2, to which the throttle valve 3 is fixed, is supported rotatably around its axis to an air intake passage. The air intake passage 1 is connected to an air cleaner on the upstream side (upper side in the figure) and to a combustion chamber of an internal combustion engine on the downstream side (bottom side of the figure). Therefore, the tilting angle of the throttle valve 3 to the air intake passage 1 is varied by rotation of the throttle shaft 2 in the direction of the arrow A, and accordingly the opening area to the air intake passage 1 of the throttle valve 3 is varied, and then the intake air flow rate entering into the combustion chamber of the internal combustion engine can be varied. The state in the figure is a fully closed state of the throttle valve.

A throttle lever 4 is fixed to one end of the throttle shaft 2. The throttle opening area to the air intake passage is increased by rotation of the throttle lever 4 in a direction shown by arrow A. One end of a tension spring 7 is attached to the throttle lever 4, and the other end is attached to a fixed portion. The tension spring 7 applies a tensile force in a direction shown by a arrow B, and the force of the tension spring 7 acts on the throttle valve 3 in a direction to fully close the air intake passage.

The drive shaft 5 is fixed to the air intake passage 1. The drive shaft 5 is rotatably supported by a drive lever 6. The accelerator pedal 8 is connected to the drive lever 6 though the throttle wire 8A. By stepping the accelerator pedal 8 in the direction of arrow C, the throttle wire 8A moves in the direction of arrow D to rotate the drive lever 6 in the direction of arrow E. One end of the tension spring 9 is attached to the driver lever 6 and the other end is attached to a fixed portion. The tension spring 9 produces a tensile force in the direction of arrow F, and the tension spring 9 acts the force on the drive lever 6 so as to rotate in the opposite direction to the direction of arrow E.

Two kinds of rotating force transmitting mechanisms are provided between the drive lever 6 and the throttle lever 4. As shown in FIG. 6, in the fully closed state of the throttle valve 3, the cam surface of the driver lever 6 touches the cam surface of the throttle lever 4 at a portion indicated by arrow X. When the drive lever 6 is rotated in the direction of the arrow E, the rotation is transmitted to the throttle lever 4 to rotate the throttle lever 4 in the direction of the arrow A because the cam surface of the drive lever 6 touches the cam surface of the throttle lever 4. The transmission of the rotating force by the cam surface is continued until the state shown in FIG. 7.

One end of the connecting lever 10 is rotatably supported by the drive lever 6 in a point P as a fulcrum. A pin 10A provided in the other end of the connecting lever 10 is slidably engaged with a long hole 4A formed in the throttle lever 4.

Because the long hole 4A is long-circular shaped, the left side end of the pin 10A of the connecting lever 10 does not touch the left side end of the long hole 4A in the state shown in FIG. 6. Therefore, in this state, even if the drive lever 6 is rotated in the direction of the arrow E and the pin 10A of the connecting lever 10 is moved to the direction of the arrow F, driving force is not transmitted from the connecting lever 10 to the throttle lever 4. That is, in the state shown in FIG. 6, the rotating force of the drive lever 6 is transmitted by the cam mechanism touching at the portion indicated by the arrow X, but the connecting lever 10 does not work.

Further, because one end of the compression spring 11 is attached to the throttle lever 4 and the other end is attached to the pin 10A of the connecting lever 10, a force to press the pin 10A toward the direction of the arrow H is applied to the pin 10A. Therefore, because the pin 10A is maintained to be pressed against the right end side of the long hole 4A, the force by the compression spring 11 acts as a force rotating the drive lever 6 toward the direction of the arrow H through the connecting lever 10.

A load set to the compression spring 11 generates such a force that the cam surface of the drive lever 6 does not detach from the cam surface of the throttle lever 4.

Therefore, in the low opening degree range of the throttle valve, because the accelerator pedal 8 is affected by the action force of the tension spring 9 and the force transmitted from the compression spring 11 through the link mechanism, the driver's feel when stepping down on the accelerator pedal can be improved. This will be described later, referring to FIG. 9.

FIG. 7 shows a state where the drive lever 4 is rotated from the state of FIG. 6 by a preset angle. In FIG. 7, the same parts are identified by the same reference characters in FIG. 6. Here, the tension spring 9 is omitted.

The state shown in FIG. 7 is a state of switching point of the cam mechanism to the link mechanism. The cam surface of the drive lever 6 touches the cam surface of the throttle lever 4 at a portion shown by the arrow Y, and at the same time the left side end of the pin 10A of the connecting lever 10 is moved toward the direction of the arrow F against the force of the compression spring 11 and touches the left side end of the long hole 4A formed in the throttle lever 4.

As the accelerator pedal 8 is further stepped down from this state and the drive lever 6 is rotated in the direction shown by the arrow E, the contact between the cam surface of the drive lever 6 and the cam surface of the throttle lever 4 is released and the cam mechanism ceases to function. At the same time, the rotation of the drive lever 6 in the direction of the arrow E rotates the throttle lever 4 in the direction of the arrow A through the connecting lever 10 by engaging the pin 10A of the connecting lever 10 with the long hole 4A.

FIG. 8 shows a state where the link mechanism operates from the state of FIG. 7 and the throttle valve is brought to the full open state. In FIG. 8, the same parts are identified by the same reference characters in FIG. 6. Here, the tension springs 7, 9 are omitted.

As the accelerator pedal 8 is further stepped down from the state of FIG. 7 and the drive lever 6 is rotated in the direction shown by the arrow E, by the action of the connecting lever 10 composing the link mechanism the pin 10A of the connecting lever 10 engages with the long hole 4A and the throttle lever 4 is rotated in the direction of the arrow A to bring the throttle valve 3 in the full open state.

When the accelerator pedal 8 is turned back, the drive lever 6 is rotated in the opposite direction of the arrow E by the action of the tension spring 9, and the throttle lever 4 is rotated in the opposite direction of the arrow A by the action of the tension spring 7 to move the throttle valve 3 toward the closed state.

When the throttle valve 3 is closed, the state changes from the state of FIG. 8 through the state of FIG. 7 to the state of FIG. 6 of the full closed state. Therefore, the throttle opening area changing ratio is determined by the link mechanism of the connecting lever 10 in the intermediate and high opening degree range, and by the cam mechanism in the low opening degree range.

In the state shown in FIG. 7, because the transmitting mechanism of the accelerator pedal stepping force is switched from the cam mechanism to the link mechanism, there is a concern that change in accelerator stepping force occurs to cause a jerky feeling of stepping the accelerator pedal. However, by employing the compression spring 11, the change in accelerator stepping force at the point switching from the cam mechanism to the link mechanism can be reduced and accordingly a smooth feeling of stepping the accelerator pedal can be attained.

Here, improvement of the feeling of stepping the accelerator pedal will be explained, referring to FIG. 9.

Figure 9:
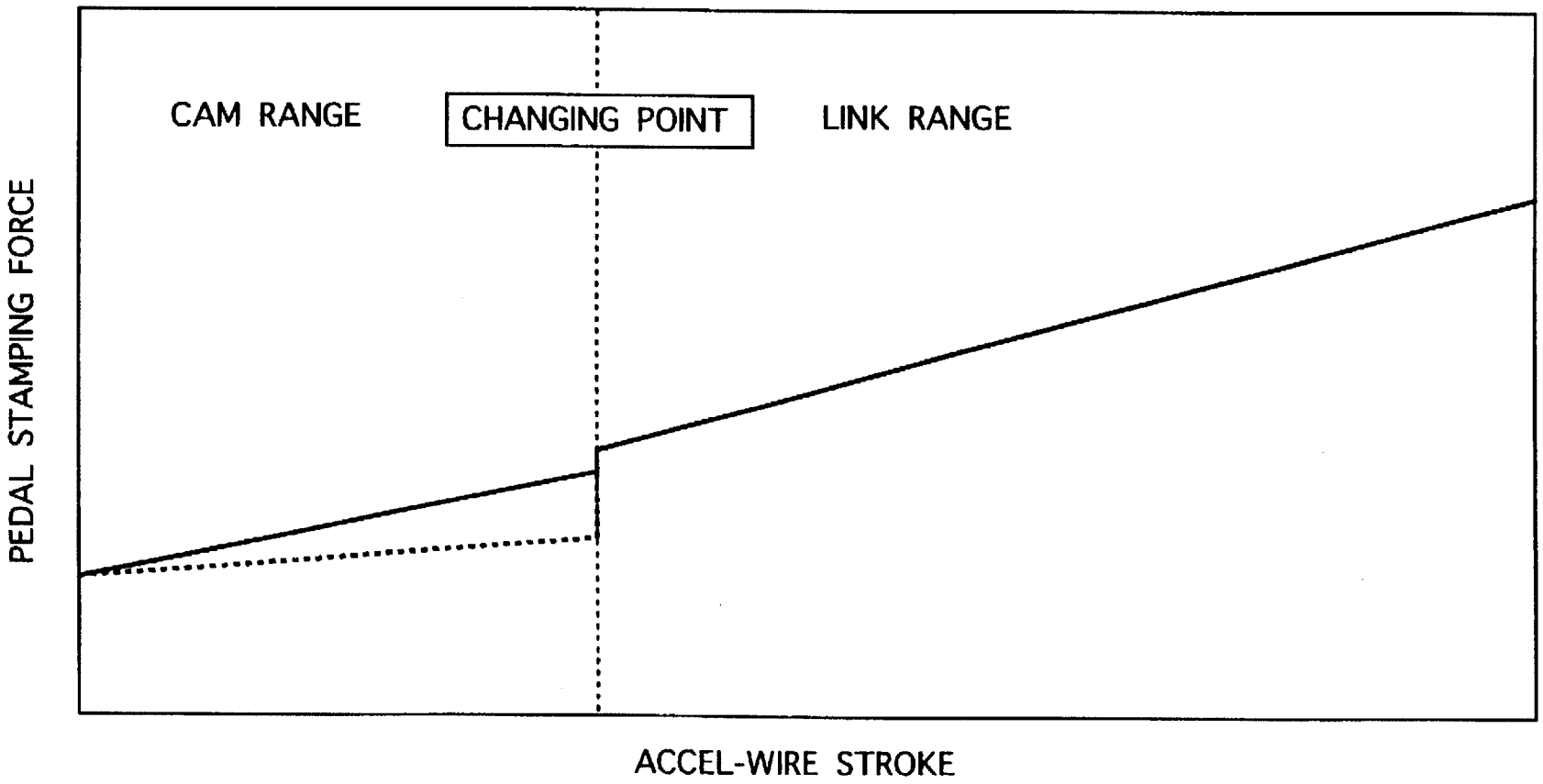
FIG. 9 is a graph showing the relation between accelerator wire stroke and pedal stepping force of another embodiment of the throttle control device in accordance with the present invention.

In FIG. 9, a dotted line shows the relationship between the accelerator wire stroke and the stepping force of the accelerator pedal in a case of not using the compression spring in accordance with the present embodiment as in the embodiment shown in FIG. 1 to FIG. 4. Because the throttle opening area changing ratio is set to a small value in the low opening degree range of the throttle, the changing ratio of the pedal stepping force to the stepping amount of the accelerator pedal (accelerator wire stroke) (the gradient of the dotted line in the figure) is small. Because the throttle opening area changing ratio is set to a large value in the intermediate and high opening degree range of the throttle, the changing ratio of the pedal stepping force to the stepping amount of the accelerator pedal (accelerator wire stroke) becomes larger compared to that in the low opening degree range (the gradient of the dotted line in the figure). In addition to this, a leap in the stepping force appears at the change point in the middle because switching from the cam mechanism to the link mechanism is performed. Speed of the vehicle at the change point is in a range of 80 km/h to 100 km/h in a high gear ratio. Therefore, when the stepping force suddenly increases during such a high speed running, a driver feels a sense of discontinuity.

The relationship between the accelerator wire stroke and the stepping force of the accelerator pedal in the present embodiment becomes as shown by the solid line in the figure. That is, the changing ratio of the pedal stepping force to the stepping amount of the accelerator pedal (accelerator wire stroke) becomes larger compared to the gradient of the dotted line because, since force opposite to the compressed direction gradually increases as the accelerator pedal is stepped deeper, the reaction force from the compression spring gradually increases and the reaction force is superposed on the change in the stepping force itself. By doing so, the relationship between the accelerator wire stroke and the stepping force of the accelerator pedal can be changed nearly uniformly from the low opening degree range to the intermediate and high opening degree range. Thus, the accelerator pedal can be operated without giving a discontinuous sense to the driver even at the switching point from the cam mechanism to the link mechanism.

Although in the above description the long hole is provided in the throttle lever side, a long hole can be provided in the drive lever side and the hole engaged with a pin provided in one end of the connector lever which is engaged with the throttle lever. According to this alternative embodiment, by providing the delayed opening characteristic of the throttle, the throttle opening area changing ratio can be made smaller in the low opening degree range, and the throttle opening area changing ratio can be much larger in the intermediate and high opening degree range. For example, in a vehicle mounting an engine having a displacement volume of nearly 4000 cc and being comparatively light in vehicle weight even having such a large displacement volume, the driving ability in a slow speed region can be improved and the sensitivity response in an intermediate and high speed region can be attained.

Further, by changing the shape of the cam surface of the cam mechanism and the proportion of the link mechanism, in a vehicle using an engine having a displacement volume as small as nearly 1000 cc, the throttle opening area changing ratio is increased in the low opening degree range in order to match the small torque at a low speed, and the throttle opening area changing ratio is decreased in the intermediate opening degree range and the high opening degree range. By doing so, the driving ability from a slow speed region to an intermediate and high speed region can be improved.

Further, by giving a force against the accelerator stepping force from the connecting lever to the drive lever by providing the compression spring, the accelerator stepping force can be varied linearly, and consequently the feeling of accelerator stepping can be improved.

Furthermore, as for the cam mechanism, the number of parts of the cam mechanism can be reduced by using the cam surface formed in the drive lever and the cam surface formed in the throttle lever.

Detailed construction of a further embodiment in accordance with the present invention will be described below, referring to FIG. 10 to FIG. 13.

Figure 10:
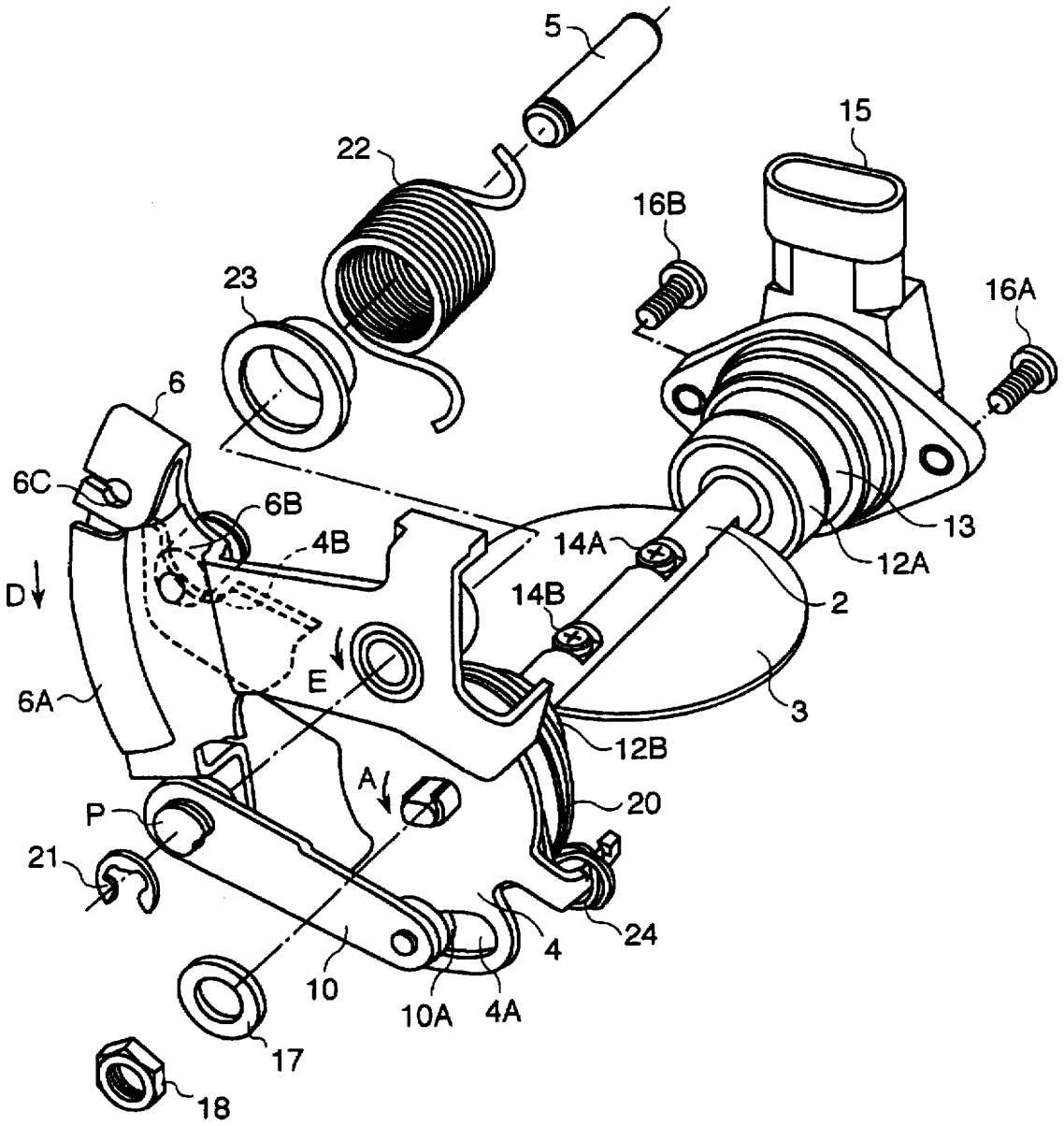
FIG. 10 is an exploded perspective view showing a main part of a further embodiment of a throttle control device in accordance with the present invention.

The throttle valve 3 in FIG. 10 is fixed to the throttle shaft 2 by screws 14A, 14B. Ball bearings 12A, 12B are attached at each side of the throttle shaft 2. The outer peripheries of the ball bearings 12A, 12B are attached to the air intake passage which is not shown. The throttle shaft 2 is rotatably supported to the air intake passage with the ball bearings 12A, 12B. A seal ring 13 having a dust seal is installed outside the ball bearing 12A to seal the space between the air intake passage and the throttle shaft 2.

A sensor portion of a throttle position sensor 15 for detecting an opening degree is connected to one end of the throttle shaft 2, and the main body of the throttle position sensor 15 is fixed to the air intake passage with screws 16A, 16B. The other end of the throttle shaft 2 is cut threads, and the throttle lever 4 is attached to the other end of the throttle shaft with a nut 18 through a spring washer 17. In order to turn the throttle lever 4 toward the fully closed direction, one end of a main spring 20 corresponding to the tension spring 7 shown in FIG. 6 is attached to the throttle lever 4, and the other end is attached to a fixed end in the air intake passage.

The drive shaft 5 is fixed to the air intake passage. The drive lever 6 is attached to one end of the drive shaft 5 and the drive shaft 5 is positioned in the thrust direction by E-shaped ring 21. In a part of the drive lever 6, a wire guide 6A is formed to which a throttle wire for transmitting the fore from the accelerator pedal, not shown, is attached, and there is also a cut 6C for attaching the tope end of the throttle wire. When the accelerator pedal, not shown, is stepped down, the wire guide 6A is pulled in the direction of the arrow E by the action of the throttle wire connected to the accelerator pedal to rotate the drive lever 6 in the direction of the arrow E.

A sub-spring 22 corresponding to the tension spring 9 shown in FIG.6 is arranged interposing a collar 23, and one end of the sub-spring 22 is attached to the drive lever 6 and the other end is attached to a fixed end of the air intake passage. The sub-spring 22 applies a force to the drive lever 6 so as to move the direction opposite to the direction of the arrow E.

One end of the connecting lever 10 is rotatably attached to the drive lever 6 with a pin P. The pin 10A is attached to the other end of the connecting lever 10, and the pin 10A is engaged with the long hole 4A formed in the throttle lever 4. The link mechanism is comprised by the connecting lever 10. The long hole 4A engaging with the pin 10A determines operation and non-operation of the link mechanism. In FIG. 10, the link mechanism constituted by the connecting lever 10 is set so as to not operate when the throttle valve 3 is fully closed.

A roller 6B is rotatably attached to the drive lever 6. A cam 4B is attached to the throttle lever 4. In the state shown in FIG. 10, the rotating surface of the roller 6B touches the cam 4B. The cam mechanism by the cam 4B operates when the throttle valve 3 is nearly fully closed.

Further, one end of an assist spring 24 corresponding to the compression spring 11 shown in FIG. 6 is attached to the throttle lever 4, and the other end is attached to the pin 10A which is attached to the connecting lever 10. The feeling of stepping the accelerator pedal is improved by the assist spring 24.

The operation of the rotating force transmitting mechanisms in the further embodiment of the present invention will be described below, referring to FIG. 11 to FIG. 13.

Figure 11:
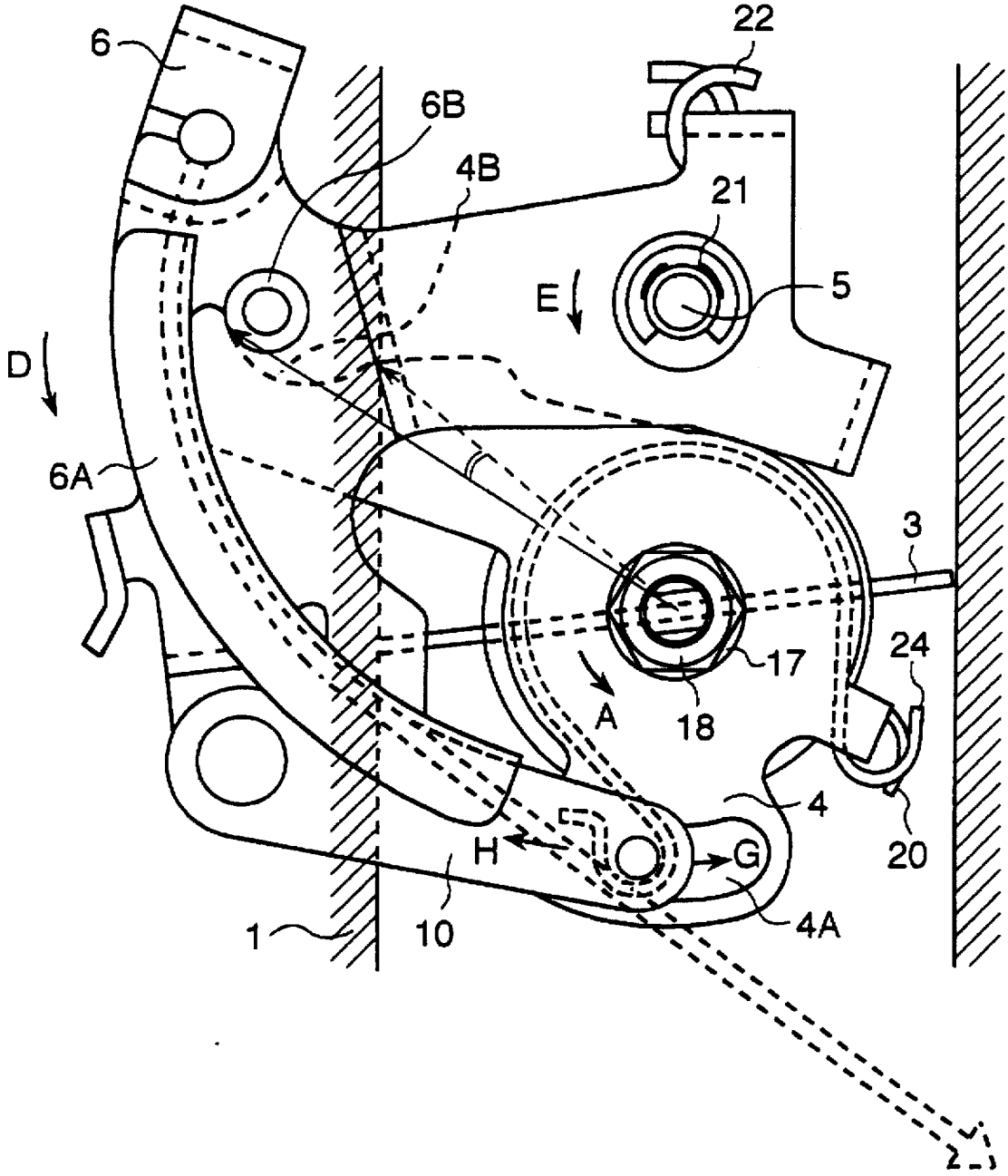
FIG. 11 is a front view illustrating the operation of transmitting rotating force by a cam mechanism in a rotating force transmitting mechanism of a further embodiment of the throttle control device in accordance with the present invention.

In FIG. 11, the throttle shaft 2, to which the throttle valve 3 is fixed, is supported rotatably around its axis to an air intake passage. The air intake passage 1 is connected to an air cleaner on the upstream side (upper side in the figure) and to a combustion chamber of an internal combustion engine on the downstream (bottom side of the figure). Therefore, the tilting angle of the throttle valve 3 to the air intake passage 1 is varied by rotation of the throttle shaft 2 in the direction of the arrow A, and accordingly the opening area to the air intake passage 1 of the throttle valve 3 is varied, and then the intake air flow rate entering into the combustion chamber of the internal combustion engine can be varied. The state in the figure is a fully closed state of the throttle valve.

A throttle lever 4 is fixed to one end of the throttle shaft 2. The throttle opening area to the air intake passage is increased by rotation of the throttle lever 4 in a direction shown by arrow A. One end of a main spring 20 is attached to the throttle lever 4, and the other end is attached to a fixed portion. The main spring 20 applies a force to the throttle valve 3 in a direction to fully close the air intake passage.

The drive shaft 5 is fixed to the air intake passage 1. The drive shaft 5 is rotatably supported by a drive lever 6. The throttle wire connected to the accelerator pedal is connected to the drive lever 6 by engaging the cut 6C though the wire guide 6A. By stepping down on the accelerator pedal 8 in the direction of arrow C, the wire guide 6A moves in the direction of arrow D to rotate the drive lever 6 in the direction of arrow E. One end of the sub-spring 22 is attached to the driver lever 6 and the other end is attached to a fixed portion in the air intake passage. The sub-spring 22 produces a force to rotate the drive lever 6 in the direction opposite to the direction of arrow E.

Two kinds of rotating force transmitting mechanisms are provided between the drive lever 6 and the throttle lever 4. The cam mechanism will be described first.

As shown in FIG. 11, in the fully closed state of the throttle valve 3, the roller 6B rotatably attached to the drive lever 6 touches the cam surface 4B of the throttle lever 4. The range of angle θ2 in the outer peripheral surface of the throttle lever 4 is an effective cam surface 4B. When the drive lever 6 is rotated in the direction of the arrow E, the rotation is transmitted to the throttle lever 4 to rotate the throttle lever 4 in the direction of the arrow A because the roller 6B of the drive lever 6 touches the cam surface 4B of the throttle lever 4. The transmission of the rotating force by the cam surface is continued until the state shown in FIG. 12.

Next, the link mechanism by the connecting lever 10 will be described. One end of the connecting lever 10 is rotatably supported by the drive lever 6 in the pin P as a fulcrum. A pin 10A provided in the other end of the connecting lever 10 is slidably engaged with a long hole 4A formed in the throttle lever 4.

Because the long hole 4A is long-circular shaped, the right side end of the pin 10A of the connecting lever 10 does not touch the right side end of the long hole 4A in the state shown in FIG. 11. Therefore, in this state, even if the drive lever 6 is rotated in the direction of the arrow E and the pin 10A of the connecting lever 10 is moved to the direction of the arrow F, driving force is not transmitted from the connecting lever 10 to the throttle lever 4. That is, in the state shown in FIG. 11, the rotating force of the drive lever 6 is transmitted by the cam mechanism composed of the roller 6B and the cam surface 4B of the throttle lever, but the connecting lever 10 does not work.

Further, because one end of the assist spring 24 is attached to the throttle lever 4 and the other end is attached to the pin 10A of the connecting lever 10, a force to press the pin 10A toward the direction of the arrow H is applied to the pin 10A. Therefore, because the pin 10A is maintained pressed against the left end side of the long hole 4A, the force by the assist spring 24 acts as a force rotating the drive lever 6 toward the direction of the arrow H through the connecting lever 10.

A load set to the assist spring 24 is sized to generate such a force that the roller 6B of the drive lever 6 does not detach from the cam surface 4B of the throttle lever 4.

Therefore, in the range of a low opening degree of the throttle valve, because the accelerator pedal 8 is affected by the action force of the sub-spring 22 and the force transmitted from the assist spring 24 through the link mechanism, the feeling stepping the accelerator pedal can be improved, as described in FIG. 9.

Figure 12:
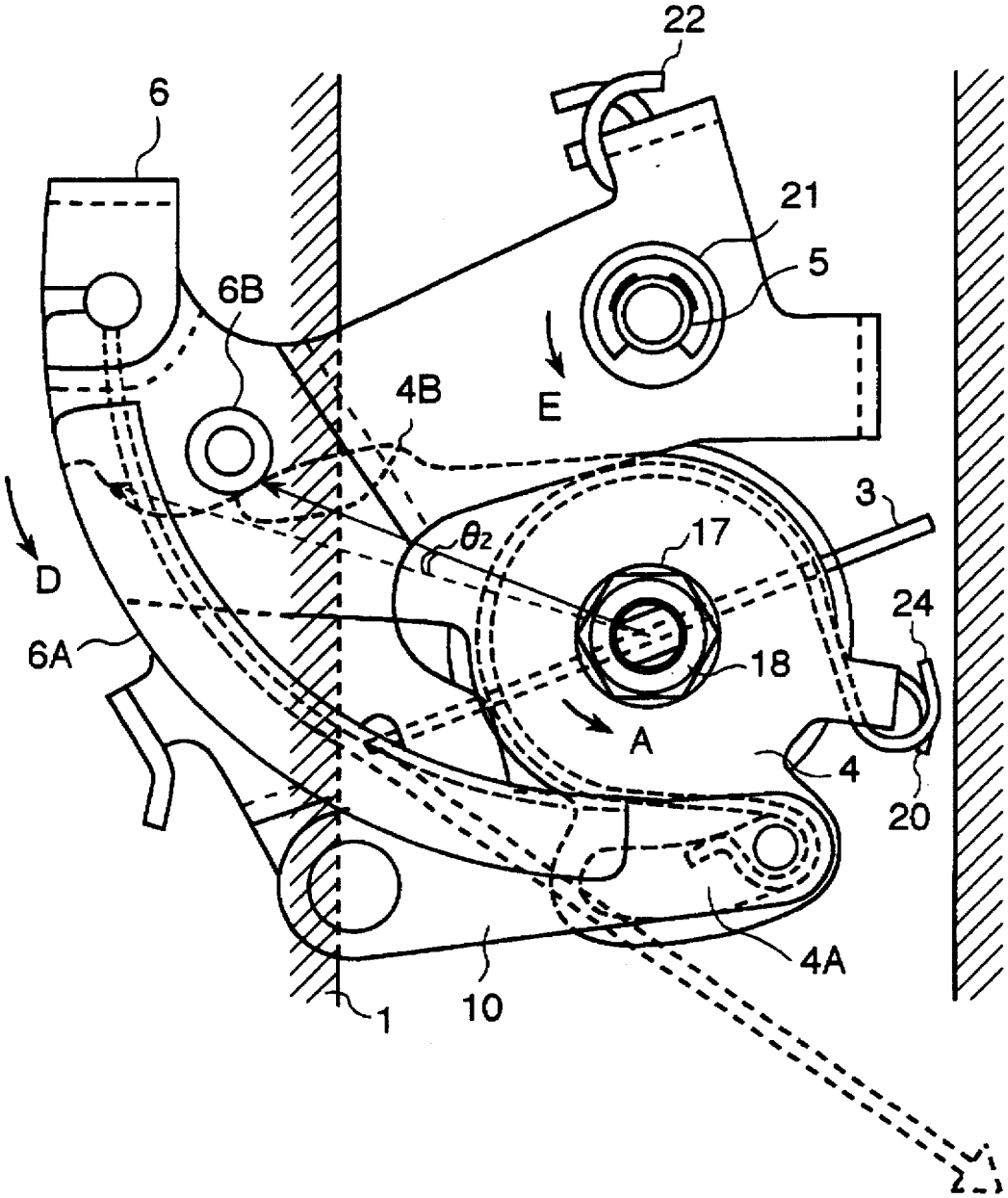
FIG. 12 is a front view illustrating the operation of transmitting rotating force at switching from the cam mechanism to a link mechanism in the rotating force transmitting mechanism of a further embodiment of the throttle control device in accordance with the present invention.

FIG. 12 shows a state where the drive lever 4 is rotated from the state of FIG. 11 by an angle θ2. In FIG. 12, the same parts are identified by the same reference characters used in FIG. 11.

The state shown in FIG. 12 is a switching point state of the cam mechanism to the link mechanism. The roller 6B of the drive lever 6 touches the cam surface 4B of the throttle lever 4, and at the same time the right side end of the pin 10A of the connecting lever 10 is moved toward the direction of the arrow F against the force of the assist spring 24 and touches the right side end of the long hole 4A formed in the throttle lever 4.

As the accelerator pedal 8 is further stepped down from this state and the drive lever 6 is rotated in the direction shown by the arrow E, the contact between the roller 6B of the drive lever 6 and the cam surface 4B of the throttle lever 4 is released and the cam mechanism ceases to function. At the same time, the rotation of the drive lever 6 in the direction of the arrow E rotates the throttle lever 4 in the direction of the arrow A through the connecting lever 10 by engaging the pin 10A of the connecting lever 10 with the long hole 4A.

Figure 13:
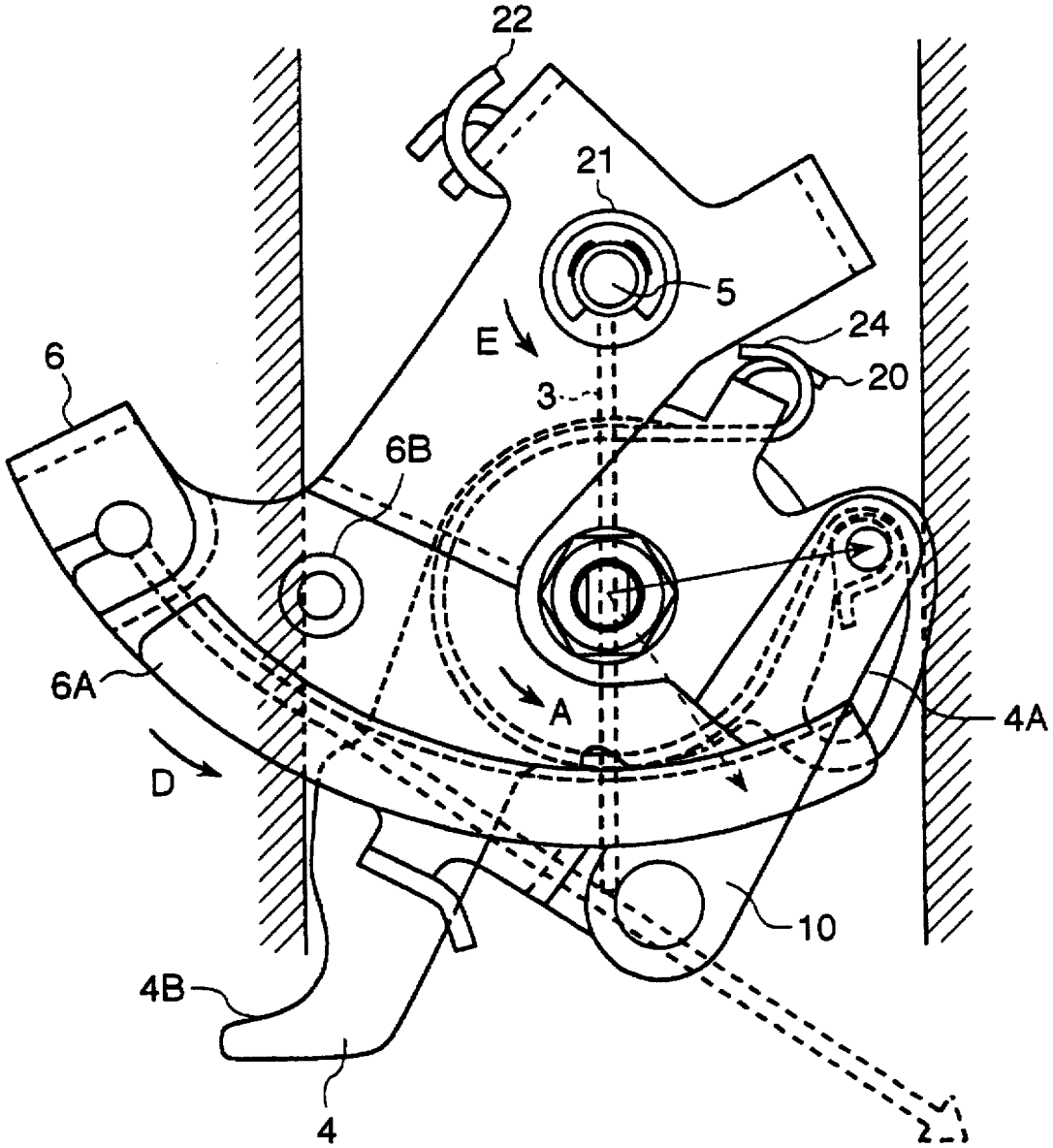
FIG. 13 is a front view illustrating the operation of transmitting rotating force by the link mechanism in the rotating force transmitting mechanism of a further embodiment of the throttle control device in accordance with the present invention.

FIG. 13 shows a state where the link mechanism operates from the state of FIG. 12 and the throttle valve is brought to the fully open state. In FIG. 13, the same parts are identified by the same reference characters used in FIG. 12.

As the accelerator pedal is further stepped down from the state of FIG. 12 and the drive lever 6 is rotated in the direction shown by the arrow E, by the action of the connecting lever 10 composing the link mechanism, the pin 10A of the connecting lever 10 engages with the long hole 4A and the throttle lever 4 is rotated in the direction of the arrow A to bring the throttle valve 3 in the fully open state.

When the accelerator pedal 8 is turned back, the drive lever 6 is rotated in the opposite direction of the arrow E by the action of the sub-spring 22, and the throttle lever 4 is rotated in the direction opposite the arrow A by the action of the main spring 20 to move the throttle valve 3 toward the closing state.

When the throttle valve 3 is closed, the state changes from the state of FIG. 13 through the state of FIG. 12 to the state of FIG. 11 of the fully closed state. Therefore, the throttle opening area changing ratio is determined by the link mechanism of the connecting lever 10 in the intermediate and high opening degree range, and by the cam mechanism in the low opening degree range.

In the state shown in FIG. 12, because the transmitting mechanism of the accelerator pedal stepping force is switched from the cam mechanism to the link mechanism, there is a concern that a change in accelerator stepping force occurs to affect a jerky feeling when stepping on the accelerator pedal. However, by employing the assist spring 24, the change in accelerator stepping force at the switching point from the cam mechanism to the link mechanism can be reduced and accordingly a smooth stepping feeling of the accelerator pedal can be attained.

The roller may also be provided in the throttle lever side instead of being provided in the driver lever without departing from the scope of the present invention.

According to this embodiment, by providing the delayed opening characteristic of the throttle, the throttle opening area changing ratio can be made smaller in the low opening degree range, and the throttle opening area changing ratio can be made larger in the intermediate and high opening degree range. For example, in a vehicle mounting an engine having a displacement volume of nearly 4000 cc and being comparatively light in vehicle weight even having such a large displacement volume, the driving ability in a slow speed region can be improved and the sensitivity response in an intermediate and high speed region can be attained.

Further, by changing the shape of the cam surface of the cam mechanism and the proportion of the link mechanism, in a vehicle using an engine having a displacement volume as small as nearly 1000 cc, the throttle opening area changing ratio is increased in the low opening degree range in order to match with the small torque at a low speed, and the throttle opening area changing ratio is decreased in the intermediate opening degree range and the high opening degree range. By doing so, the driving ability from a slow speed region to an intermediate and high speed region can be improved.

Further, by providing a force against the accelerator stepping force from the connecting lever to the drive lever via the compression spring, the accelerator stepping force can be varied linearly, and consequently the feeling of accelerator stepping can be improved.

Furthermore, as for the cam mechanism, the reliability of the cam mechanism can be improved, and the cam mechanism configuration can be extended with an arbitrary cam characteristic by using the roller and the cam surface.

A fourth embodiment of the present invention will be described in detail below, referring to FIG. 14 to FIG. 16.

This embodiment differs from the embodiment shown in FIG. 6 to FIG. 8 is that the long hole is provided in the drive lever side.

Figure 14:
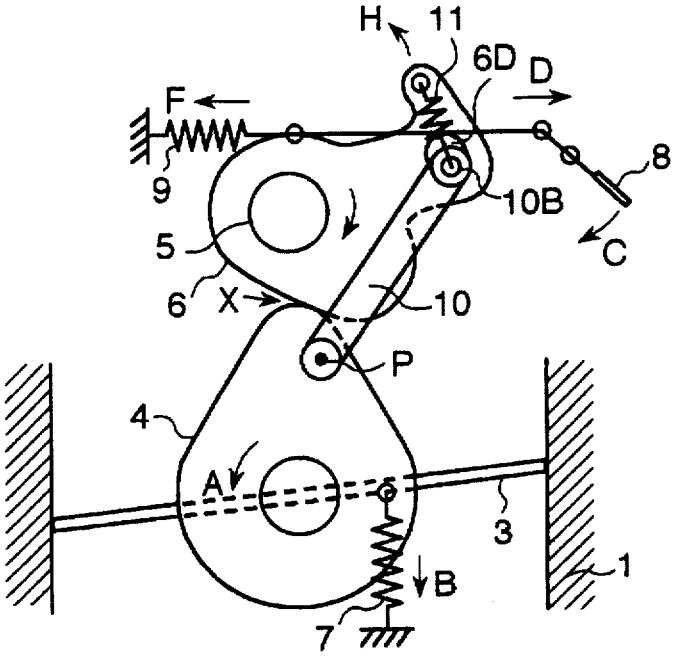
FIG. 14 is a front view illustrating the operation of transmitting rotating force by a cam mechanism in a rotating force transmitting mechanism of the fourth embodiment of the throttle control device in accordance with the present invention.

In FIG. 14, the throttle shaft 2, to which the throttle valve 3 is fixed, is supported rotatably around its axis to an air intake passage. The air intake passage 1 is connected to an air cleaner on the upstream side (upper side in the figure) and to a combustion chamber of an internal combustion engine on the downstream side (bottom side of the figure). Therefore, the tilting angle of the throttle valve 3 to the air intake passage 1 is varied by rotation of the throttle shaft 2 in the direction of the arrow A, and accordingly the opening area to the air intake passage 1 of the throttle valve 3 is varied. Then the intake air flow rate entering into the combustion chamber of the internal combustion engine can be varied. The state in FIG. 14 is a fully closed state of the throttle valve.

A throttle lever 4 is fixed to one end of the throttle shaft 2. The throttle opening area to the air intake passage is increased by rotation of the throttle lever 4 in a direction shown by arrow A. One end of tension spring 7 is attached to the throttle lever 4, and the other end is attached to a fixed portion. The tension spring 7 applies a tensile force in a direction shown by arrow B, and the force of the tension spring 7 acts on the throttle valve 3 in a direction to fully close the air intake passage.

The drive shaft 5 is fixed to the air intake passage 1 and is rotatably supported by a drive lever 6. The accelerator pedal 8 is connected to the drive lever 6 through the throttle wire 8A. By stepping the accelerator pedal 8 in the direction of arrow C, the throttle wire 8A moves in the direction of arrow D to rotate the drive lever 6 in the direction of arrow E. One end of the tension spring 9 is attached to the driver lever 6 and the other end is attached to a fixed portion. The tension spring 9 produces a tensile force in the direction of arrow F, and the tension spring 9 acts the force on the drive lever 6 so as to rotate in the opposite direction to the direction of arrow E.

Two kinds of rotating force transmitting mechanisms are provided between the drive lever 6 and the throttle lever 4. The cam mechanism will be described first. As shown in FIG. 14, in the fully closed state of the throttle valve 3, the cam surface of the driver lever 6 touches the cam surface of the throttle lever 4 at a portion indicated by arrow X. When the drive lever 6 is rotated in the direction of the arrow E, the rotation is transmitted to the throttle lever 4 to rotate the throttle lever 4 in the direction of the arrow A because the cam surface of the drive lever 6 touches the cam surface of the throttle lever 4. The transmission of the rotating force by the cam surface is continued until the state shown in FIG. 15.

Next, the link mechanism comprised by the connecting lever 10 will be described below. One end of the connecting lever 10 is rotatably supported by the throttle lever 4 at a point P as a fulcrum. A pin 10B provided in the other end of the connecting lever 10 is slidably engaged with a long hole 6D formed in the drive lever 6.

Because the long hole 6D is long-circular shaped, the left side end of the pin 10B of the connecting lever 10 does not touch the left side end of the long hole 6D in the state shown in FIG. 14. Therefore, in this state, even if the drive lever 6 is rotated in the direction of the arrow E, a driving force by the drive lever 6 is not transmitted to the throttle lever 4 through the connecting lever 10. That is, in the state shown in FIG. 14, the rotating force of the drive lever 6 is transmitted by the cam mechanism touching at the portion indicated by the arrow X, but the connecting lever 10 does not work.

Further, because one end of the compression spring 11 is attached to the drive lever 6 and the other end is attached to the pin 10B of the connecting lever 10, the force exerted by the compression spring 11 acts as a force rotating the drive lever 6 toward the direction of the arrow H through the connecting lever 10.

A load set to the compression spring 11 is sized to generate such a force that the cam surface of the drive lever 6 does not detach from the cam surface of the throttle lever 4.

Therefore, in the low opening degree range of the throttle valve, because the accelerator pedal 8 is affected by the action force of the tension spring 9 and the force transmitted from the compression spring 11 through the link mechanism, the stepping feeling of the accelerator pedal can be improved.

Figure 15:
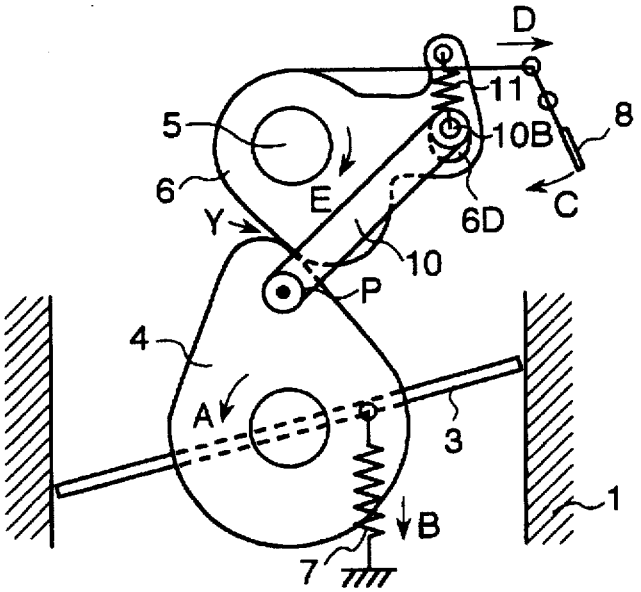
FIG. 15 is a front view illustrating the operation of transmitting rotating force at switching from the cam mechanism to a link mechanism in the rotating force transmitting mechanism of the fourth embodiment of the throttle control device in accordance with the present invention.

FIG. 15 shows a state where the drive lever 4 is rotated from the state of FIG. 14 by a preset angle. In FIG. 15, the same parts are identified by the same reference characters used in FIG. 14. Here, the tension spring 9 is omitted.

The state shown in FIG. 15 is a switching point state of the cam mechanism to the link mechanism. The figure, the cam surface of the drive lever 6 touches the cam surface of the throttle lever 4 at a portion lever 4 at a portion shown by the arrow Y, and at the same time the upper side end of the pin 10B of the connecting lever 10 is moved toward the direction of the arrow F against the force of the compression spring 11 and touches the left side end of the long hole 6D formed in the drive lever 6.

As the accelerator pedal 8 is further stepped down from this state and the drive lever 6 is rotated in the direction shown by the arrow E, the contact between the cam surface of the drive lever 6 and the cam surface of the throttle lever 4 is released and the cam mechanism ceases to function. At the same time, the rotation of the drive lever 6 in the direction of the arrow E rotates the throttle lever 4 in the direction of the arrow A through the connecting lever 10 by engaging the pin 10B of the connecting lever 10 with the long hole 6D.

Figure 16:
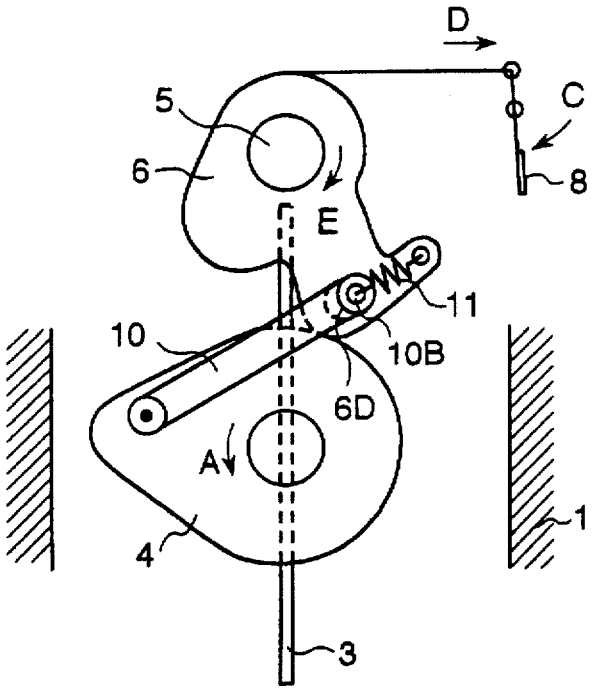
FIG. 16 is a front view illustrating the operation of mechanism in the transmitting rotating force by the link rotating force transmitting mechanism of the fourth embodiment of the throttle control device in accordance with the present invention.

FIG. 16 shows a state where the link mechanism operates from the state of FIG. 15 and the throttle valve is brought to the fully open state. In FIG. 16, the same parts are identified by the same reference characters used in FIG. 14. Here, the tension springs 7, 9 are omitted.

As the accelerator pedal 8 is further stepped down from the state of FIG. 15 and the drive lever 6 is rotated in the direction shown by the arrow E, by the action of the connecting lever 10 composing the link mechanism, the pin 10B of the connecting lever 10 engages with the long hole 6D and the throttle lever 4 is rotated in the direction of the arrow A to bring the throttle valve 3 in the fully open state.

When the accelerator pedal 8 is turned back, the drive lever 6 is rotated in the direction opposite to the arrow E by the action of the tension spring 9, and the throttle lever 4 is rotated in the direction opposite to the arrow A by the action of the tension spring 7 to move the throttle valve 3 toward the closed state.

When the throttle valve 3 is closed, the state changes from the state of FIG. 16 through the state of FIG. 15 to the state of FIG. 14 of the full closed state. Therefore, the throttle opening area changing ratio is determined by the link mechanism of the connecting lever 10 in the intermediate and high opening degree range, and by the cam mechanism in the low opening degree range.

In the state shown in FIG. 15, because the transmitting mechanism of the accelerator pedal stepping force is switched from the cam mechanism to the link mechanism, there is a concern that a change in accelerator stepping force occurs to affect an unnatural feeling when stepping down on the accelerator pedal. However, by employing the compression spring 11, the change in accelerator stepping force at the switching point from the cam mechanism to the link mechanism can be reduced and accordingly a smooth feeling when stepping down on the accelerator pedal can be attained.

According to this embodiment, by providing the delayed opening characteristic of the throttle, the throttle opening area changing ratio can be made smaller in the low opening degree range, and the throttle opening area changing ratio can be made larger in the intermediate and high opening degree range. Therefore, the driving ability in a slow speed region can be improved and the sensitivity response in an intermediate and high speed region can be attained.

Further, by changing the shape of the cam surface of the cam mechanism and the proportion of the link mechanism, the throttle opening area changing ratio is increased in the low opening degree range, and the throttle opening area changing ratio is decreased in the intermediate opening degree range and the high opening degree range. By doing so, the driving ability from a slow speed region to an intermediate and high speed region can be improved.

Further, by providing a force against the accelerator stepping force from the connecting lever to the drive lever via the compression spring, the accelerator stepping force can be varied linearly, and consequently the feeling of accelerator stepping can be improved.

Furthermore, as for the cam mechanism, the number of parts of the cam mechanism can be reduced by using the cam surface formed in the drive lever and the cam surface formed in the throttle lever.

A fifth embodiment of the present invention will be described in detail below, referring to FIG. 17 to FIG. 19.

In this embodiment, the link mechanism is used in the low opening degree range of the throttle valve, and the cam mechanism is used in the intermediate and high opening degree range of the throttle valve.

Figure 17:
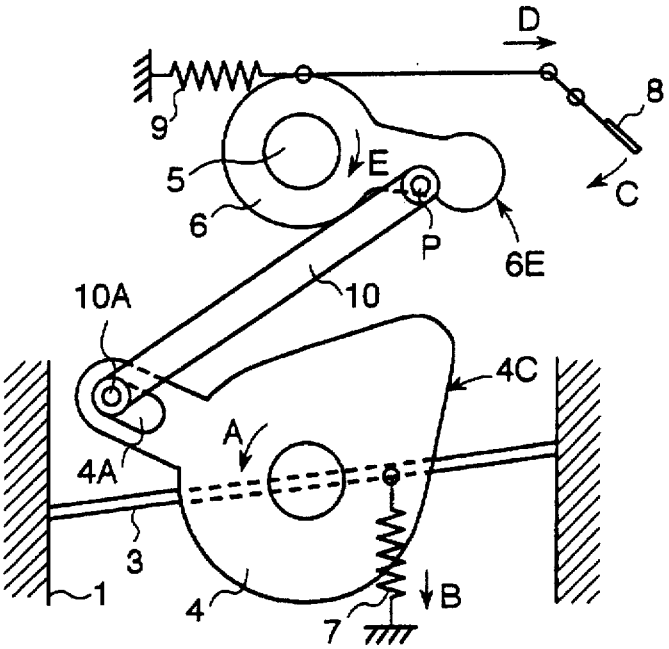
FIG. 17 is a front view illustrating the operation of transmitting rotating force by a cam mechanism in a rotating force transmitting mechanism of the fifth embodiment of the throttle control device in accordance with the present invention.

In FIG. 17, the throttle shaft 2, to which the throttle valve 3 is fixed, is supported rotatably around its axis to an air intake passage. The air intake passage 1 is connected to an air cleaner on the upstream side (upper side in the figure) and to a combustion chamber of an internal combustion engine on the downstream (bottom side of the figure). Therefore, the tilting angle of the throttle valve 3 to the air intake passage 1 is varied by rotation of the throttle shaft 2 in the direction of the arrow A, and accordingly the opening area to the air intake passage 1 of the throttle valve 3 is varied. Then the intake air flow rate entering into the combustion chamber of the internal combustion engine can be varied. The state in FIG. 17 is a fully closed state of the throttle valve.

A throttle lever 4 is fixed to one end of the throttle shaft 2. The throttle opening area to the air intake passage is increased by rotation of the throttle lever 4 in a direction shown by arrow A. One end of tension spring 7 is attached to the throttle lever 4, and the other end is attached to a fixed portion. The tension spring 7 applies a tensile force in a direction shown by arrow B, and the force of the tension spring 7 acts on the throttle valve 3 in a direction to fully close the air intake passage.

The drive shaft 5 is fixed to the air intake passage 1 and is rotatably supported by a drive lever 6. The accelerator pedal 8 is connected to the drive lever 6 though the throttle wire 8A. By stepping down on the accelerator pedal 8 in the direction of arrow C, the throttle wire 8A moves in the direction of arrow D to rotate the drive lever 6 in the direction of arrow E. One end of the tension spring 9 is attached to the driver lever 6 and the other end is attached to a fixed portion. The tension spring 9 produces a tensile force in the direction of arrow F and provides the force on the drive lever 6 so as to rotate the latter in a direction opposite to the direction of arrow E.

Two kinds of rotating force transmitting mechanisms are provided between the drive lever 6 and the throttle lever 4. The link mechanism will be described first. As shown in FIG. 17, one end of the connecting lever 10 is rotatably supported by the drive lever 6 in a point P as a fulcrum. A pin 10A provided in the other end of the connecting lever 10 is slidably engaged with a long hole 4A formed in the throttle lever 4. When the drive lever is rotated in the direction of the arrow E, the rotation is transmitted to the throttle lever 4 though the connecting lever 10 to rotate the throttle lever 4 in the direction of the arrow A because the connecting lever is engaged in the left end of the long hole 4A. The transmission of the rotating force by the cam surface is continued until the state shown in FIG. 18.

Next, the cam mechanism will be described below. As shown in FIG. 17, in the fully closed state of the throttle valve 3, the cam surface 6B of the driver lever 6 touches the cam surface 4C of the throttle lever 4. Therefore, even when the drive lever 6 is rotated in the direction of the arrow E in this state, the rotation cannot be transmitted to the throttle lever 4. That is, in the state shown in FIG. 17, the rotating force of the drive lever 6 is transmitted by the link mechanism by the connecting lever 10, but the cam mechanism does not function.

Figure 18:
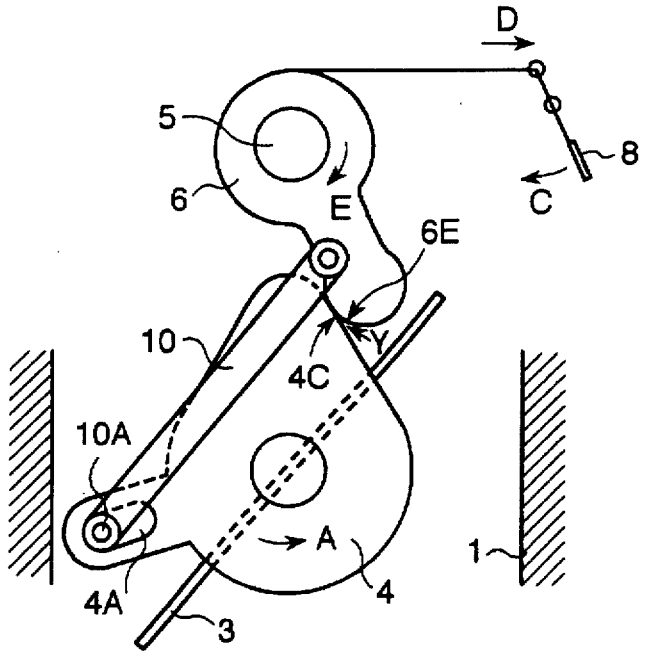
FIG. 18 is a front view illustrating the operation of transmitting rotating force at switching from the cam mechanism to a link mechanism in the rotating force transmitting mechanism of the fifth embodiment of the throttle control device in accordance with the present invention.

FIG. 18 shows a state where the drive lever 4 is rotated from the state of FIG. 17 by a preset angle. In FIG. 18, the same parts are identified by the same reference characters used in FIG. 17. Here, the tension spring 9 is omitted.

The state shown in FIG. 18 is a switching point state of the link mechanism to the cam mechanism. The cam surface 6E of the drive lever 6 touches the cam surface 4C of the throttle lever 4 at a portion shown by the arrow Y, and at the same time the left side end of the pin 10A of the connecting lever 10 touches the left side end of the long hole 4A formed in the throttle lever 4.

As the accelerator pedal 8 is further stepped down from this state and the drive lever 6 is rotated in the direction shown by the arrow E, the contact between the cam surface of the drive lever 6 and the cam surface of the throttle lever 4 is maintained and the cam mechanism functions. At the same time, the link mechanism by the connecting lever 10 ceases functioning, and the throttle lever 4 is rotated in the direction of the arrow A.

Figure 19:
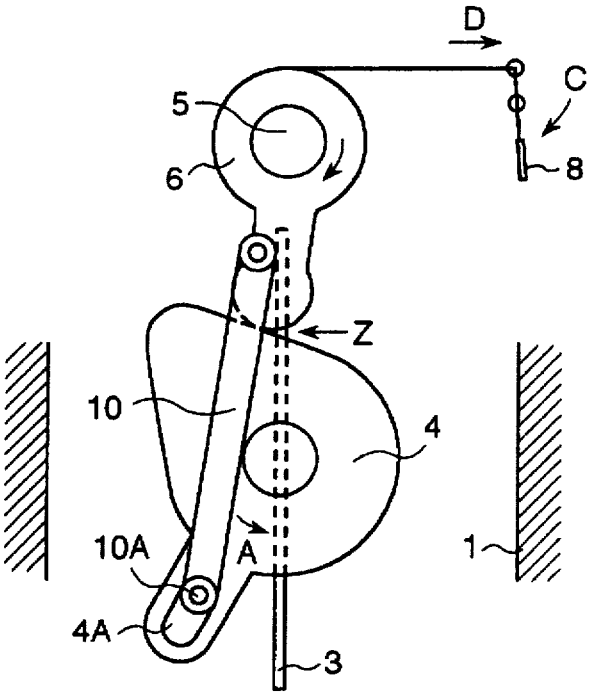
FIG. 19 is a front view illustrating the operation of mechanism in the transmitting rotating force by the link rotating force transmitting mechanism of the fifth embodiment of the throttle control device in accordance with the present invention.

FIG. 19 shows a state where the cam mechanism operates from the state of FIG. 18 and the throttle valve is brought to the fully open state. In FIG. 19, the same parts are identified by the same reference characters used in FIG. 17. Here, the tension springs 7, 9 are omitted.

As the accelerator pedal 8 is further stepped down from the state of FIG. 18 and the drive lever 6 is rotated in the direction shown by the arrow E, the throttle lever 4 is rotated in the direction of the arrow A to bring the throttle valve 3 in the fully open state by the contact action of the cam mechanism at the portion indicated by the arrow Z.

When the accelerator pedal 8 is turned back, the drive lever 6 is rotated in the opposite direction of the arrow E by the action of the tense spring 9, and the throttle lever 4 is rotated in the opposite direction of the arrow A by the action of the tense spring 7 to move the throttle valve 3 toward the closed state.

When the throttle valve 3 is closed, the state changes from the state of FIG. 19 through the state of FIG. 18 to the state of FIG. 17 of the fully closed state. Therefore, the throttle opening area changing ratio is determined by the cam mechanism in the intermediate and high opening degree range, and by the link mechanism of the connecting lever 10 in the low opening degree range.

According to this embodiment, even if the link mechanism is used in the low opening degree range and the link mechanism in the intermediate and high opening degree range, the throttle opening area changing ratio can be set using an arbitrary characteristic.

Although the driving mechanism of the throttle in the last-mentioned embodiment switches from the cam mechanism to the link mechanism or from the link mechanism to the cam mechanism, the throttle opening area changing ratio can be set to a further arbitrary characteristic by using the cam mechanism and the link mechanism such as switching the cam mechanism to the link mechanism and then to the cam mechanism.

Further, as for the cam mechanism, the number of parts of the cam mechanism can be reduced by using the cam surface formed in the drive lever and the cam surface formed in the throttle lever.

According to the present invention, in the throttle control device, the throttle opening area changing ratio can be set to an arbitrary characteristic from the low opening degree range to the intermediate and high opening degree range.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A throttle control device comprising:

a throttle valve rotatably supported on an air intake passage for varying an area of the air intake passage;

a throttle lever operatively connected with the throttle valve for rotating the throttle valve;

a drive lever being operatively linked with an accelerator pedal;

a cam mechanism for transmitting rotation of the drive lever to the throttle lever; and a link mechanism for transmitting the rotation of said drive lever to throttle lever;

wherein the cam mechanism and the link mechanism are operationally switched corresponding to an opening degree of the throttle valve.

2. A throttle control device according to claim 1, wherein the cam mechanism is operative when the throttle valve is in a low opening degree range, and the link mechanism is operative when the throttle valve is in an intermediate and high opening degree range.

3. A throttle control device according to claim 1, wherein the link mechanism is operative when the throttle valve is in a low opening degree range, and the cam mechanism is operative when the throttle valve is in an intermediate and high opening degree range.

4. A throttle control device according to claim 1, wherein a changing ratio of the throttle valve in a low opening degree range is smaller than a changing ratio of the throttle valve in an intermediate and high opening degree range.

5. A throttle control device according to claim 1, wherein a changing ratio of the throttle valve in a low opening degree range is larger than a changing ratio of the throttle valve in an intermediate and high opening degree range.

6. A throttle control device according to claim 1, wherein the cam mechanism comprises a cam surface formed on one the driver lever and the throttle lever and arranged to engage with a part of the other of the driver lever and the throttle lever;

the link mechanism comprises a connecting lever having one end supported by the throttle lever and another end in which a pin provided and engaged with a long hole formed in the driver lever;

the pin is play-coupled with the long hole such that the link mechanism does not function when the cam mechanism is operative; and the cam mechanism is arranged to be brought in a non-contact state so as not to function when the link mechanism is operative.

7. A throttle control device according to claim 3, further comprising:

an assisting device for exerting a force in a closing direction of the throttle valve when the cam mechanism is operative, wherein the force varies corresponding to an opening degree of the throttle valve.

8. A throttle control device according to claim 6, wherein the cam mechanism comprises a cam surface formed in a portion of the driver lever and arranged to engage with a cam surface formed in a portion of the throttle lever.

9. A throttle control device according to claim 1, wherein the cam mechanism comprises a cam surface formed on one of the driver lever and the throttle lever and arranged to engage a part of the other of the driverlever and the throttle lever;

the link mechanism comprises a connecting lever having one end supported by the driver lever and another end in which a pin is provided and engaged with a long hole formed in the throttle lever;

the pin is play-coupled with the long hole such that the link mechanism does not function when the cam mechanism is operative; and the cam mechanism is arranged to be brought in a non-contact state so is not to function when the link mechanism is operative.

10. A throttle control device according of claim 9, wherein the cam mechanism comprises a cam surface formed in a portion of the driver lever and arranged to engage with a cam surface formed in a portion of the throttle lever.

11. A throttle control device according to claim 9, further comprising:

an assisting device for exerting a force in a closing direction of the throttle valve when the cam mechanism is operative, wherein the force varies corresponding to an opening degree of the throttle valve.

12. A throttle control device according to claim 11, wherein the assisting device comprises a compressed spring having one end engaged with the pin of the connecting lever and another end engaged with one of the driver lever and the throttle lever.

13. A throttle control device according to of claim 9, wherein the cam mechanism comprises a cam surface formed in a portion of the driver lever and is arranged to engage with a roller rotatably supported in a portion of the throttle lever.

14. A throttle control device according to claim 13, wherein the cam mechanism comprises a cam surface formed in a portion of the driver lever and is arranged to engage with a roller rotatably supported in a portion of the throttle lever.

15. A throttle control device comprising a throttle valve rotatably supported in a vehicle air intake passage;

means for varying an opening degree of the throttle valve;

first means for transmitting movement of a vehicle accelerator pedal to the varying means;

second means for transmitting movement of the vehicle accelerator pedal to the varying means; and switching means for switching one of the first means and the second means to an operational state in dependence upon the opening degree of the throttle valve.

16. A throttle control device according to claim 15, wherein one of the first and second means is operative when the throttle valve is in a low opening degree range, and the other of the first and second means is operative when the throttle valve is above the low opening degree range.

17. A throttle control device according to claim 15, wherein a changing ratio of the throttle valve is a low opening degree range is selectively one of smaller and larger than the changing ratio above the low opening degree range.

18. A throttle control device according to claim 15, wherein an assisting means exerts a force in a closing direction of the throttle valve when one of the first and second means is operative.

19. A throttle control device according to claim 18, wherein the force is variable in relation to the opening degree of the throttle valve.

* * * * *